United States Patent [19]

Maskasky

[11] Patent Number: 4,463,087

[45] **Date of Patent: * Jul. 31, 1984**

[54] CONTROLLED SITE EPITAXIAL SENSITIZATION OF LIMITED IODIDE SILVER HALIDE EMULSIONS

[75] Inventor: Joe E. Maskasky, Rochester, N.Y.

[73] Assignee: Eastman Kodak Company, Rochester, N.Y.

[ * ] Notice: The portion of the term of this patent subsequent to Mar. 6, 2001 has been disclaimed.

[21] Appl. No.: 451,367

[22] Filed: Dec. 20, 1982

[51] Int. Cl.[3] ..... G03C 1/02; G03C 1/12

[52] U.S. Cl. ..... 430/567; 430/569; 430/570; 430/581; 430/591

[58] Field of Search ..... 430/567, 569, 570, 581, 430/591

[56] References Cited

U.S. PATENT DOCUMENTS

| | | | |
|---|---|---|---|
| 3,140,179 | 7/1964 | Russell | 430/434 |
| 3,152,907 | 10/1964 | Godowsky | 430/545 |
| 3,505,068 | 4/1970 | Beckette et al. | 430/138 |
| 3,656,962 | 4/1972 | Levy | 430/569 |
| 3,804,629 | 4/1974 | Hammerstein et al. | 430/569 |
| 3,852,066 | 12/1974 | Levy | 430/84 |
| 3,852,067 | 12/1974 | Levy | 430/93 |
| 4,094,684 | 6/1978 | Maskasky | 430/569 |
| 4,142,900 | 3/1979 | Maskasky | 430/567 |

FOREIGN PATENT DOCUMENTS

| | | |
|---|---|---|
| 0019917 | 12/1980 | European Pat. Off. . |
| 505012 | 8/1930 | Fed. Rep. of Germany . |
| 3019733 | 12/1981 | Fed. Rep. of Germany . |
| 1027146 | 4/1966 | United Kingdom . |
| 2038792A | 7/1980 | United Kingdom . |
| 2063499A | 6/1981 | United Kingdom . |

OTHER PUBLICATIONS

Shiozawa, "Electron Microscopic Study on Conversion of Silver Halides I & II", Bulletin of the Soc. of Photo. Science and Technology of Japan, No. 22, Dec. 1972, pp. 6–20.

Klein, et al., "Untersuchung über die Konvertierung der Silberhalogenide", Photo. Korr., 102, pp. 59–63, (1966).

Steigmann, *Photographische Industrie,* "Green- and Brown-Developing Emulsions", vol. 34, pp. 764, 766 and 872, published Jul. 8 and Aug. 5, 1938.

Berry and Skillman, "Surface Structures and Epitaxial Growths on AgBr Microcrystals", *Journal of Applied Physics,* vol. 35, No. 7, Jul. 1964, pp. 2165–2169.

Suzuki and Ueda, "The Active Sites for Chemical Sensitization of Monodisperse AgBr Emulsions", 1973, SPSE Tokyo Symposium.

*Primary Examiner*—Mary F. Downey

*Attorney, Agent, or Firm*—Carl O. Thomas

[57] ABSTRACT

Silver halide emulsions of limited iodide content, processes for the preparation of these emulsions, photographic elements incorporating these emulsions, and processes for the use of the photographic elements are disclosed. In the emulsions silver halide grains predominantly bounded by {111} crystal faces and containing insufficient iodide to direct silver salt epitaxy to selected surface sites of the grains are present. Silver salt is epitaxially located on and substantially confined to selected surface sites of the silver halide grains, this being accomplished by the use of an adsorbed site director.

40 Claims, 22 Drawing Figures

1 μm

1 μm

2μm

2 μm 1 um 0.25 μm 0.25 μm

1μm

1μm

1 μm

CONTROLLED SITE EPITAXIAL SENSITIZATION OF LIMITED IODIDE SILVER HALIDE EMULSIONS

FIELD OF THE INVENTION

The invention relates to silver halide photography and specifically to emulsions and photographic elements containing radiation-sensitive silver halide of limited iodide content as well as to processes for the preparation of the emulsions and use of the photographic elements.

PRIOR ART

Koitabashi et al European patent application No. 0019917 (published Dec. 10, 1980) discloses epitaxially depositing on silver halide grains containing from 15 to 40 mole percent iodide silver halide which contains less than 10 mole percent iodide. The present invention constitutes an improvement over Koitabashi et al.

The following additional prior art is considered generally less pertinent, but is discussed for added perspective.

Steigmann German Pat. No. 505,012, issued August 12, 1930, teaches forming silver halide emulsions which upon development have a green tone. This is achieved by precipitating silver halide under conditions wherein potassium iodide and sodium chloride are introduced in succession. Examination of emulsions made by this process indicates that very small silver iodide grains, substantially less than 0.1 micron in mean diameter, are formed. Separate silver chloride grains are formed, and electron micrographs now suggest that silver chloride is also epitaxially deposited on the silver iodide grains. Increasing the silver iodide grain size results in a conversion of the desired green tone to a brown tone. An essentially cumulative teaching by Steigmann appears in *Photographische Industrie,* "Green- and Brown-Developing Emulsions", Vol. 34, pp. 764, 766, and 872, published July 8 and Aug. 5, 1938.

Klein et al U.K. Pat. No. 1,027,146 discloses a technique for forming composite silver halide grains. Klein et al forms silver halide core or nuclei grains and then proceeds to cover then with one or more contiguous layers of silver halide. The composite silver halide grains contain silver chloride, silver bromide, silver iodide, or mixtures thereof. For example, a core of silver bromide can be coated with a layer of silver chloride or a mixture of silver bromide and silver iodide, or a core of silver chloride can have deposited thereon a layer of silver bromide. In depositing silver chloride on silver bromide Klein et al teaches obtaining the spectral response of silver bromide and the developability characteristics of silver chloride.

Lapp German OLS No. 3,019,733 describes the preparation of a Lippmann type emulsion in the presence of a growth inhibitor such as adenine or a spectral sensitizing dye, followed by the dissolution and reprecipitation of the Lippmann emulsion onto a more sparingly soluble emulsion in the presence of a silver halide solvent. The ratio of Lippmann emulsion to the host emulsion indicates that a core-shell structure is formed.

Beckett et al U.S. Pat. No. 3,505,068 uses the techniques taught by Klein et al to prepare a slow emulsion layer to be employed in combination with a faster emulsion layer to achieve lower contrast for a dye image. The silver halide grains employed in the slow emulsion layer have a core of silver iodide or silver haloiodide and a shell which is free of iodide composed of, for example, silver bromide, silver chloride, or silver chlorobromide.

Investigation has been directed toward forming composite silver halide grains in which a second silver halide does not form a shell surrounding a first, core silver halide. Maskasky U.S. Pat. No. 4,094,684 discloses the epitaxial deposition of silver chloride onto silver iodide which is in the form of truncated bipyramids (a hexagonal structure of wurtzite type). Maskasky has disclosed that the light absorption characteristics of silver iodide and the developability characteristics of silver chloride can be both achieved by the composite grains. Maskasky U.S. Pat. No. 4,142,900 is essentially cumulative, but differs in that the silver chloride is converted after epitaxial deposition to silver bromide by conventional halide conversion techniques. Koitabashi et al U.K. Patent application No. 2,053,499A is essentially cumulative with Maskasky, but directly epitaxially deposits silver bromide on silver iodide.

Hammerstein et al U.S. Pat. No. 3,804,629 discloses that the stability of silver halide emulsion layers against the deleterious effect of dust, particularly metal dust, is improved by adding to physically ripened and washed emulsion before chemical ripening a silver chloride emulsion or by precipitating silver chloride onto the physically ripened and washed silver halide emulsion. Hammerstein et al discloses that silver chloride so deposited will form hillocks on previously formed silver bromide grains.

Berry and Skillman, "Surface Structures and Epitaxial Growths on AgBr Microcrystals", *Journal of Applied Physics,* Vol. 35, No. 7, July 1964, pp. 2165–2169, discloses the growth of silver chloride on silver bromide. Octahedra of silver bromide form growths all over their surface and are more reactive than cubes. Cubes from growths primarily at their corners and along their edges. Twinned tabular crystals form growths randomly distributed over their major crystal faces, with some preference for growths near their edges being observed. In addition, linear arrangements of growths can be produced after the emulsion coatings have been bent, indicating the influence of slip bands.

Levy U.S. Pat. Nos. 3,656,962, 3,852,066, and 3,852,067, teach the incorporation of inorganic crystalline materials into silver halide emulsions. It is stated that the intimate physical association of the silver halide grains and the inorganic crystals can alter the sensitivity of the silver halide emulsion to light. Russell U.S. Pat. No. 3,140,179 teaches that the speed and contrast of an optically sensitized emulsion can be further increased by coating therebeneath an emulsion comprised predominantly of silver chloride and having a sufficiently low speed that no visible image is produced in it by exposure and development of the optically sensitized emulsion. Godowsky U.S. Pat. No. 3,152,907 teaches a similar advantage for blending a low speed silver chloride emulsion with an optically sensitized silver chloride or silver bromoiodide emulsion.

Haugh et al U.K. patent application No. 2,038,792A teaches the selective sensitization of cubic grains bounded by {100} crystallographic faces at the corners of the cubes. This is accomplished by first forming tetradecahedral silver bromide grains. These grains are ordinary cubic grains bounded by {100} major crystal faces, but with the corners of the cubes elided, leaving in each instance a {111} crystallographic surface. Silver chloride is then deposited selectively onto these {111} crystallographic surfaces. The resulting grains can be selectively chemically sensitized at the silver chloride corner sites. This localization of sensitization improves photosensitivity. The composite crystals are diclosed to respond to sensitization as if they were silver chloride, but to develop, fix, and wash during photographic processing as if they were silver bromide. Haugh et al provides no teaching or suggestion of how selective site sensitization could be adapted to grains having only {111} crystallographic surfaces. Suzuki and Ueda, "The Active Sites for Chemical Sensitization of Monodisperse AgBr Emulsions", 1973, SPSE Tokyo Symposium, appears cumulative, except that very fine grain silver chloride is Ostwald ripened onto the corners of silver bromide cubes.

SUMMARY OF THE INVENTION

In one aspect this invention is directed to a silver halide emulsion comprised of a dispersing medium and silver halide host grains predominantly bounded by {111} crystal faces and containing insufficient iodide to direct silver salt epitaxy to selected surface sites of the grains, and silver salt epitaxially located on and substantially confined to selected surface sites of the grains.

In another aspect, this invention is directed to a photographic element comprised of a support and at least one radiation-sensitive emulsion layer comprised of a radiation-sensitive emulsion as described below.

In still another aspect, this invention is directed to producing a visible photographic image by processing in an aqueous alkaline solution in the presence of a developing agent an imagewise exposed photographic element as described above.

In an additional aspect this invention is directed to a process of preparing a silver halide emulsion by providing an emulsion comprised of a dispersing medium and silver halide host grains predominantly bounded by {111} crystal faces and epitaxially depositing a silver salt on the silver halide host grains. The improvement comprises selecting as the silver halide host grains those containing insufficient iodide to direct silver salt epitaxy to selected surface sites on the silver halide host grains, adsorbing a site director on the silver halide host grains, and substantially confining epitaxial deposition to selected sites on the silver halide host grains.

It has been discovered that silver halide emulsions containing silver halide host grains bounded by predominantly {111} crystal faces and of limited iodide content exhibit improved sensitivity when silver salt epitaxially deposited on the host grains is substantially confined to selected surface sites. Koitabashi et al, cited above, has previously demonstrated such improvements in sensitivity for silver bromoiodide host grains containing from 15 to 40 mole percent iodide. Unfortunately silver bromoiodide emulsions containing such high levels of iodide find few practical applications in silver halide photography. (Note, for example, James and Higgins, *Fundamentals of Photographic Theory,* John Wiley, 1948, p. 12, and Duffin, *Photographic Emulsion Chemistry,* Focal press, 1966, p. 18.) Silver bromoiodide emulsions are commonly of limited iodide content to avoid disadvantages in preparation and use. For example, a disadvantage of preparing silver bromoiodide emulsions containing the high iodide levels required by Koitabashi et al is that the precipitation of host grains is slow as compared to the precipitation of otherwise comparable grains of lower iodide content. In processing iodide is a potent development inhibitor, rendering emulsions of such high iodide content difficult to develop satisfactorily in common photographic developers and requiring frequent developer replenishment to avoid iodide ion poisoning.

The disadvantage of relatively high iodide content in the silver bromoiodide host grains of Koitabashi et al has been avoided by the discovery of a novel process for substantially confining epitaxially deposited salts to selected surface sites. Whereas Koitabashi et al relies upon having at least 15 mole percent iodide in the host grains to locate epitaxial deposition, it has been discovered that epitaxial deposition can be selectively directed onto silver halide host grains which contain insufficient iodide to direct silver salt epitaxial deposition to selected surface sites.

DESCRIPTION OF PREFERRED EMBODIMENTS

Figure 1:
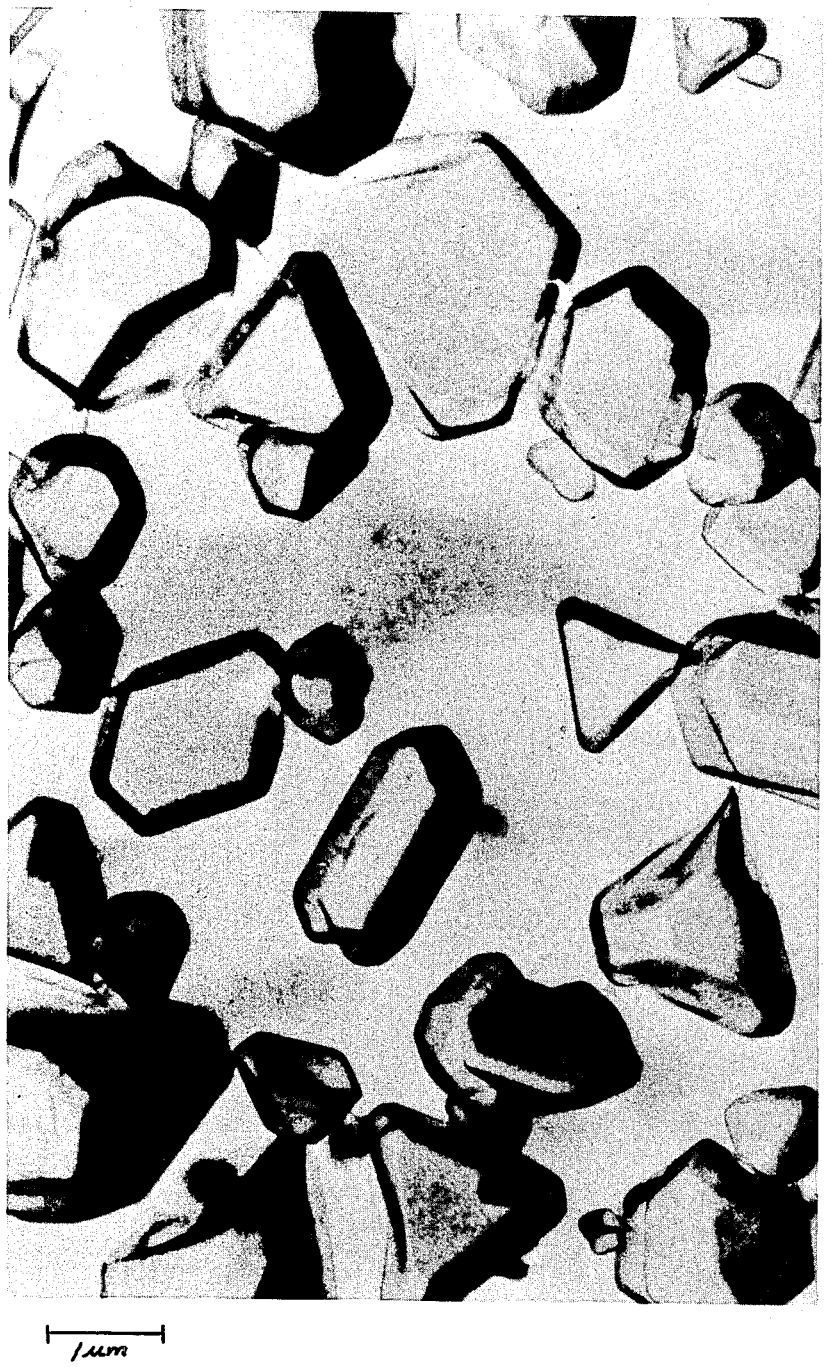
FIGS. 1 through 22 are electron micrographs of emulsion samples.

In the practice of the present invention silver salt epitaxy is located on and substantially confined to selected surface sites of host silver halide grains. The host silver halide grains can be provided by any conventional silver halide emulsion the grains of which are predominantly bounded by {111} crystal faces and are of limited iodide content. As employed herein "limited iodide content" is used to mean that the host grains contain insufficient iodide to direct silver salt epitaxy to selected surface sites of the silver halide host grains.

A wide variety of conventional silver halide emulsions containing such host grains are known in the art. The host grains can be comprised of silver bromide, silver chloride, silver chlorobromide, silver chloroiodide, silver bromoiodide, silver chlorobromoiodide, or mixtures thereof, it being understood that they are of limited iodide content. Generally satisfactory emulsions containing host grains bounded by {111} crystal faces can be prepared by a variety of techniques—e.g., single-jet, double TM jet (including continuous removal techniques), accelerated flow rate, and interrupted precipitation techniques, as illustrated by Trivelli and Smith, *The Photographic Journal,* Vol. LXXIX, May, 1939, pp. 330–338, T.H. James, *The Theory of the Photographic Process,* 4th Ed., Macmillan, 1977, Chapter 3, Nietz et al U.S. Pat. No. 2,222,264, Wilgus German OLS 2,107,118, Lewis U.K. Pat. Nos. 1,335,925, 1,430,465, and 1,469,480, Irie et al U.S. Pat. No. 3,650,757, Morgan U.S. Pat. No. 3,917,485, Musliner U.S. Pat. No. 3,790,387, Evans U.S. Pat. No. 3,716,276, and Gilman et al U.S. Pat. No. 3,979,213.

Modifying compounds can be Present during host grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure,* Vol. 134, June 1975, Item 13452. *Research Disclosure* and its predecessor, *Product Licensing Index,* are publications of Industrial Opportunities Ltd.; Homewell, Havant; Hampshire, P09 1EF, United Kingdom.

In double-jet precipitation of the host grain emulsions, which is the preferred method of preparation, individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korrespondenz,* Band 102, Number 10, 1967, p. 162. In order to obtain rapid distribution of the reactants within the reaction vessel, specially contructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. patent application No. 2,022,431A, Saito et al German OLS Nos. 2,555,364 and 2,556,885, and *Research Disclosure,* Volume 166, February 1978, Item 16662.

Obtaining host grains having predominantly {111} crystal faces can be assured by controling pAg during their precipitation. (As herein employed pAg is the negative logarithm of silver ion concentration.) It is known that {100} crystal face formation is favored at higher silver ion concentrations (lower pAg) while {111} crystal face formation is favored at lower silver ion concentrations (higher pAg). The exact pAg at which {111} crystal face formation can be obtained varies principally as a function of the halide and temperature employed during precipitation. In general predominantly {111} crystal faces can be obtained for silver bromide and limited iodide content silver bromoiodide emulsions at a pAg of about 9.0 or higher. Gutoff U.S. Pat. No. 3,773,516 provides a specific teaching of precipitating silver bromide and limited iodide content silver bromoiodide while controlling pBr (the negative logarithm of bromide ion concentration) to control the crystal faces formed. Silver chloride emulsions show a marked preference for {100} crystal faces, but the precipitation of silver chloride emulsions presenting {111} crystal faces is taught by Wyrsch, "Sulfur Sensitization of Monosized Silver Chloride Emulsions with {111} {110}, and {100} Crystal Habit", Paper III13, *International Congress of Photographic Science,* pp. 122–124, 1978.

As herein employed "predominantly bounded by {111} crystal faces" means that greater than 50% of the total surface area of the silver halide host grains is provided by {111} crystal faces. Preferably and in most instances all of the major crystal faces are {111} crystal faces.

The host grains can be of any shape compatible with having predominantly {111} crystal faces. The host grains can be either regular or irregular. For example, the host grains can be regular octahedra. In a preferred form which is the subject matter of Maskasky U.S. Ser. No. 431,855, filed Sept. 30, 1982, titled CONTROLLED SITE EPITAXIAL SENSITIZATION, commonly assigned, the host grains are high aspect ratio tabular grains. As employed by Maskasky "high aspect ratio tabular grains" are defined as having a thickness of less than 0.3 micron, a diameter of at least 0.6 micron, and an average aspect ratio of greater than 8:1. Further, Maskasky requires that such tabular grains account for at least 50 percent of the total projected area of the silver halide emulsion in which they are contained. In addition to the high aspect ratio tabular grains disclosed by Maskasky, this invention extends also to grains having aspect ratios of less than 8:1. Tabular grains of high, low, or intermediate aspect ratios are contemplated for use in the practice of this invention. Further, other irregular grains, such as singly twinned grains, can also be employed.

Koitabashi et al has recognized that at least 15 mole percent iodide is required in silver bromoiodide regular octahedra to cause epitaxy to be deposited on and confined to selected surface sites of the host grains. I have observed that more iodide is required in regular octahedra to direct silver salt epitaxy than is required using irregular host grains. For. example, Maskasky U.S. Ser. No. 431,855, cited above, provides examples of iodide concentrations of 12 mole percent directing epitaxy to controlled sites, and it is my belief that selective site epitaxy can be achieved under at least some conditions on high aspect ratio tabular grains with iodide concentrations as low as 8 mole percent. In examples below, however, I demonstrate that thick platelets, which are believed to contain twin planes and which contain 9 mole percent iodide, allow random deposition of epitaxy to occur. Thus, the maximum iodide content of the host grains employed in the practice of this invention will in all instances be below 15 mole percent. Maximum iodide concentrations are in general a function of the grain crystal structure, including irregularities, such as twin planes. Further, it is my belief that the more uniformly iodide is distributed in the host grains during their precipitation, the more effective it is in directing epitaxy. However, in all instances host grains containing less than 10 mole percent iodide will benefit in epitaxy siting by the practice of this invention. Further with host grains iodide concentrations below 8 mole percent the practice of this invention is in all instances required to achieve silver salt epitaxy substantially confined to selected surface sites of the host grains.

It is a feature of the present invention that the limited iodide content silver halide host grains having predominantly {111} crystal faces bear at least one silver salt epitaxially grown thereon. That is, the silver salt is in a crystalline form having its orientation controlled by the silver halide grain forming the crystal substrate on which it is grown. Further, the silver salt epitaxy is substantially confined to selected surface sites. For example, the silver salt epitaxy is preferably substantially confined to the edges and/or corners of the host grains. By confining the silver salt epitaxy to the selected sites it is substantially excluded in a controlled manner from most of the surface area of the {111} crystal faces of the host grains.

An improvement in sensitivity can be achieved by confining epitaxial deposition to selected sites on the host grains as compared to allowing the silver salt to be epitaxially deposited randomly over the major faces of the tabular grains. The degree to which the silver salt is confined to selected sensitization sites, leaving at least a portion of the major crystal faces substantially free of epitaxially deposited silver salt, can be varied widely without departing from the invention. In general, larger increases in sensitivity are realized as the epitaxial coverage of the {111} crystal faces decreases. It is specifically contemplated to confine epitaxially deposited silver salt to less than half the total surface area of the crystal faces of the host grains, preferably less than 25 percent, and in certain forms optimally to less than 10 or even 5 percent of the total surface area of the major crystal faces of the host grains. Thus, where epitaxy is limited, it may be substantially confined to selected corner and/or edge sensitization sites and effectively excluded from the {111} crystal faces.

In one preferred embodiment of the present invention a silver bromoiodide emulsion of limited iodide content is chemically sensitized by epitaxy at ordered grain sites. The silver bromoiodide grains have {111} major crystal faces. An aggregating spectral sensitizing dye is first adsorbed to the surfaces of the host grains by conventional spectral sensitizing techniques. Sufficient dye is preferably employed to provide a monomolecular adsorbed coverage of at least 70 percent of the total grain surface. Although dye concentrations are conveniently calculated in terms of monomolecular coverages, it is recognized that the dye does not necessarily distribute itself uniformly on the grain surfaces. (More dye can be introduced than can be adsorbed to the grain surface, if desired, but this is not preferred, since the excess dye does not further improve performance.) The aggregated dye is employed at this stage of sensitization not for its spectral sensitizing properties, but for its ability to direct epitaxial deposition of silver chloride onto the host silver bromoiodide grains. Thus, any other adsorbable species capable of directing epitaxial deposition and capable of being later displaced by spectral sensitizing dye can be employed. Since the aggregated dye performs both the functions of directing epitaxial deposition and spectral sensitization and does not require removal once positioned, it is clearly a preferred material for directing epitaxial deposition.

Once the aggregated dye is adsorbed to the surfaces of the silver bromoiodide grains, deposition of silver chloride can be undertaken by conventional techniques of precipitation or Ostwald ripening. The epitaxial silver chloride does not form a shell over the silver bromoiodide grains nor does it deposit randomly. Rather it is deposited selectively in an ordered manner adjacent the edges of the host grains. Generally the slower the rate of epitaxial deposition the fewer the sites at which epitaxial deposition occurs. Thus, epitaxial deposition can, if desired, be confined to less than all the edges and corners. The epitaxial silver chloride can itself act to increase markedly the sensitivity of the resulting composite grain emulsion without the use of additional chemical sensitization.

In the foregoing specific preferred embodiment of the invention the host grains are silver bromoiodide grains of limited iodide content while silver chloride is epitaxially deposited onto the host grains at ordered sites. However, it is specifically contemplated that the host grains and the silver salt sensitizer can take a variety of forms.

The sensitizing silver salt that is deposited onto the host tabular grains at selected sites can be generally chosen from among any silver salt capable of being epitaxially grown on the host halide grain and heretofore known to be useful in photography. The anion content of the silver salt and the host silver halide grains differ sufficiently to permit differences in the respective crystal structures to be detected. It is specifically contemplated to choose the silver salts from among those heretofore known to be useful in forming shells for core-shell silver halide emulsions. In addition to all the known photographically useful silver halides, the silver salts can include other silver salts known to be capable of precipitating onto silver halide grains, such as silver thiocyanate, silver phosphate, silver cyanide, silver carbonate, and the like. The selective site deposition of a noncubic crystal lattice silver salt on a cubic silver halide host grain does not require the use of an adsorbed site director. However, it is within the contemplation of this invention to improve siting of noncubic silver salts further by employing an adsorbed site director. Depending upon the silver salt chosen and the intended application, the silver salt can usefully be deposited in the presence of any of the modifying compounds described above in connection with the silver halide host grains. Some of the silver halide forming the host grains usually enters solution during epitaxial deposition and is incorporated in the silver salt epitaxy. For example a silver chloride deposit on a silver bromide host grain will usually contain a minor proportion of bromide ion. Thus, reference to a particular silver salt as being epitaxially located on a host grain is not intended to exclude the presence of some silver halide of a composition also present in the host grain, unless otherwise indicated.

It is generally preferred as a matter of convenience that the silver salt exhibit a higher solubility than the silver halide of the host grain. This reduces any tendency toward dissolution of the host grain while the silver salt is being deposited. This avoids restricting sensitization to just those conditions which minimize host grain dissolution, as would be required, for example, if deposition of a less soluble silver salt onto a host grain formed of a more soluble silver halide is undertaken. Since silver bromoiodide is less soluble than silver bromide, silver chloride, or silver thiocyanate and can readily serve as a host for deposition of each of these salts, it is preferred that the host grains consist essentially of silver bromoiodide. Silver chloride, being more soluble than either silver bromoiodide or silver bromide, can be readily epitaxially deposited on grains of either of these halide compositions and is a preferred silver salt for selective site sensitization. Silver thiocyanate, which is less soluble than silver chloride, but much more soluble than silver bromide or silver bromoiodide, can be substituted for silver chloride, in most instances. Random epitaxial deposition of less soluble silver salts onto more soluble silver halide host grains has been reported in the art, and similar, but controlled site epitaxial deposition, can be undertaken in the practice of this invention. For instance the epitaxial deposition of silver bromoiodide onto silver bromide or the deposition of silver bromide or thiocyanate onto silver chloride is specifically contemplated.

The epitaxial deposition of more than one silver salt onto a given silver halide host grain is specifically contemplated. Multilevel epitaxy—that is, silver salt epitaxy located on a differing silver salt which is itself epitaxially deposited onto the host grain—is specifically contemplated. For example, it is possible to epitaxially grow silver thiocyanate onto silver chloride which is in turn epitaxially grown on a silver bromoiodide or silver bromide host grain. It is also possible to grow more than one silver salt directly on the host grain. For example, silver thiocyanate, having a noncubic crystal lattice can be grown on the edges of a host grain in the absence of an adsorbed site director. Thereafter a site director can be adsorbed to the remaining host grain surfaces and a silver halide salt, such as silver chloride, epitaxially grown selectively at the corners of the host grains. It is also contemplated that random site epitaxy can be present in addition to and separate from controlled site epitaxy. For example, following controlled site epitaxy of silver thiocyanate random silver halide epitaxial deposition can be undertaken.

Controlled site epitaxy can be achieved over a wide range of epitaxially deposited silver salt concentrations. Incremental sensitivity can be achieved with silver salt concentrations as low as about 0.05 mole percent, based on total silver present in the composite sensitized grains. On the other hand, maximum levels of sensitivity are achieved with silver salt concentrations of less than 50 mole percent. Generally epitaxially deposited silver salt concentrations of from 0.3 to 25 mole percent are preferred, with concentrations of from about 0.5 to 10 mole percent being generally optimum for sensitization.

Depending upon the composition of the silver salt epitaxy and the silver halide host grains, the silver salt can sensitize either by acting as a hole trap or an electron trap. In the latter instance the silver salt epitaxy also locates the latent image sites formed on imagewise exposure. Modifying compounds present during epitaxial deposition of silver salt, such as compounds of copper, thallium, lead, bismuth, cadmium, zinc, middle chalcogens (i.e., sulfur, selenium, and tellurium), gold and Group VIII noble metals, are particularly useful in enhancing sensitization. The presence of electron trapping metal ions in the silver salt epitaxy is useful in favoring the formation of internal latent images. For example, a particularly preferred embodiment of the present invention is to deposit silver chloride on a silver bromoiodide host grain as described above in the presence of a modifying compound favoring electron trapping, such as a lead or iridium compound. Upon imagewise exposure internal latent image sites are formed in the host grains at the doped silver chloride epitaxy sensitization sites.

Another approach for favoring the formation of an internal latent image associated with the epitaxially deposited silver salt is to undertake halide conversion after epitaxial deposition of the silver salt. For example, where the epitaxially deposited salt is silver chloride, it can be modified by contact with a halide of lower solubility, such as a bromide salt or a mixture of bromide and iodide salts. This results in the substitution of bromide and iodide ions, if present, for chloride ions in the epitaxial deposit. The concentration of iodide ions, where employed, is preferably limited to minimize bromide displacement in the host grains. Resulting crystal imperfections are believed to account for internal latent image formation. Halide conversion of epitaxial salt deposits is taught by Maskasky, U.S. Pat. 4,142,900, here incorporated by reference.

Since silver salt epitaxy on the host grains can act either as an electron trap or as a hole trap, it is appreciated that silver salt epitaxy acting as a hole trap in combination with silver salt epitaxy acting as an electron trap forms a complementary sensitizing combination. For example, it is specifically contemplated to sensitize host grains selectively with electron trapping silver salt epitaxy as well as hole trapping silver salt epitaxy. Specific arrangements are disclosed in Maskasky U.S. Ser. No. 431,855, cited above and here incorporated by reference. A latent image can be formed at the electron trapping epitaxy site while the remaining epitaxy further enhances sensitivity by trapping photogenerated holes that would otherwise be available for annihilation of photogenerated electrons. In a specific illustrative form silver chloride is epitaxially deposited on a silver bromoiodide tabular grain containing a central region of less than 5 mole percent iodide with the remainder of the major crystal faces containing a higher percentage of iodide. The silver chloride is epitaxially deposited in the presence of a modifying compound favoring electron trapping, such a compound providing a lead or iridium dopant. Thereafter hole trapping silver salt epitaxy can be selectively deposited at the corners of the host tabular grains or as a ring along the edges of the major crystal faces by using an adsorbed site director. For example, silver thiocyanate or silver chloride including a copper dopant can be deposited on the host tabular grains. Other combinations are, of course, possible. For example, the central epitaxy can function as a hole trap while the epitaxy at the corners of the host tabular grains can function as an electron trap when the locations of the modifying materials identified above are exchanged.

Although the epitaxial deposition of silver salt is discussed above with reference to selective site sensitization, it is appreciated that the controlled site epitaxial deposition of silver salt can be useful in other respects. For example, the epitaxially deposited silver salt can improve the incubation stability of the tabular grain emulsion. It can also be useful in facilitating partial grain development and in dye image amplification processing, as is more fully discussed below. The epitaxially deposited silver salt can also relieve dye desensitization. It can also facilitate dye aggregation by leaving major portions of silver bromoiodide crystal surfaces substantially free of silver chloride, since many aggregating dyes more efficiently adsorb to silver bromoiodide as compared to silver chloride grain surfaces. Another advantage that can be realized is improved developability. Also, localized epitaxy can produce higher contrast.

Conventional chemical sensitization can be undertaken prior to controlled site epitaxial deposition of silver salt on the host grain or as a following step. When silver chloride and/or silver thiocyanate is deposited on silver bromoiodide, a large increase in sensitivity is realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensi TM tizers can be reduced, if desired, where (1) epitaxial deposition itself improves sensitivity or (2) sensitization is directed to epitaxial deposition sites. Substantially optimum sensitization of silver bromoiodide emulsions have been achieved by the epitaxial deposition of silver chloride without further chemical sensitization. If silver bromide is epitaxially deposited on silver bromoiodide, a much larger increment in sensitivity is realized when further chemical sensitization following selective site deposition is undertaken together with the use of conventional finishing times and temperatures.

When an adsorbed site director is employed which is itself an efficient spectral sensitizer, such as an aggregated dye, no spectral sensitization step following chemical sensitization is required. However, in a variety of instances spectral sensitization during or following chemical sensitization is contemplated. When no spectral sensitizing dye is employed as an adsorbed site director, such as when an aminoazaindene (e.g., adenine) is employed as an adsorbed site director, spectral sensitization, if undertaken, follows chemical sensitization. If the adsorbed site director is not itself a spectral sensitizing dye, then the spectral sensitizer must be capable of displacing the adsorbed site director or at least obtaining sufficient proximity to the grain surfaces to effect spectral sensitization. Surprisingly, the incorporation of soluble iodide salts into the host grain emulsions prior to epitaxial deposition an.d at concentrations as low as 0.1 mole percent iodide is effective to achieve controlled site epitaxial deposition. In this instance iodide ions are adsorbed to the host grain surfaces and act as adsorbed site directors. The term "adsorbed" as employed in this instance includes reaction of the iodide ions with the host grains at or near their surfaces. The use of iodide ions as an adsorbed site director is advantageous in that they need not be displaced to permit effective spectral sensitization to be achieved and in many instances actually enhance spectral sensitization.

In many instances even when an adsorbed spectral sensitizing dye is employed as a site director, it is still desirable to perform a spectral sensitization step following chemical sensitization. An additional spectral sensitizing dye can either displace or supplement the spectral sensitizing dye employed as a site director. For example, additional spectral sensitizing dye can provide additive or, most preferably, supersensitizing enhancement of spectral sensitization. It is, of course, recognized that it is immaterial whether the spectral sensitizers introduced after chemical sensitization are capable of acting as site directors for chemical sensitization.

Any conventional technique for chemical sensitization following controlled site epitaxial deposition can be employed. In general chemical sensitization should be undertaken based on the composition of the silver salt deposited rather than the composition of the host grains, since chemical sensitization is believed to occur primarily at the silver salt deposition sites or perhaps immediately adjacent thereto.

The silver halide emulsions of the present invention can be chemically sensitized before or after epitaxial deposition with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30 to 80° C., as illustrated by *Research Disclosure,* Vol. 120, April 1974, Item 12008, *Research Disclosure,* Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, preferably in concentrations of from 2 X $10^{-3}$ to 2 mole percent, based on silver, as described in Damschroder U.S. Pat. No. 2,642,361; sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Pat. No. 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure,* Vol. 136, August 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

In addition to being chemically sensitized the silver halide emulsions of the present invention are preferably also spectrally sensitized. It is specifically contemplated to employ spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The silver halide emulsions of this invention can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a double bond or methine linkage, a basic heterocyclic nucleus of the cyanine dye type and an acidic nucleus, such as can be derived from barbituric acid, 2 TM thiobarbituric acid, rhodanine, hydantoin, 2-thiohydantoin, 4-thiohydantoin, 2-pyra- zolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering*, Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al. U.S. Pat. No. 2,131,038 and Shiba et al. U.S. Pat. No. 3,930,860.

In a preferred form of this invention the spectral sensitizing dyes also function as adsorbed site directors during silver salt deposition and chemical sensitization. Useful dyes of this type are aggregating dyes. Such dyes exhibit a bathochromic or hypsochromic increase in light absorption as a function of adsorption on silver halide grains surfaces. Dyes satisfying such criteria are well known in the art, as illustrated by T. H. James, *The Theory of the Photographic Process*, 4th Ed., Macmillan, 1977, Chapter 8 (particularly, F. Induced Color Shifts in Cyanine and Merocyanine Dyes) and Chapter 9 (particularly, H. Relations Between Dye Structure and Surface Aggregation) and F. M. Hamer, *Cyanine Dyes and Related Compounds*, John Wiley and Sons, 1964, Chapter XVII (particularly, F. Polymerization and Sensitization of the Second Type). Merocyanine, hemicyanine, styryl, and oxonol spectral sensitizing dyes which produce H aggregates (hypsochromic shifting) are known to the art, although J aggregates (bathochromic shifting) are not common for dyes of these classes. Preferred spectral sensitizing dyes are cyanine dyes which exhibit either H or J aggregation.

In a specifically preferred form the spectral sensitizing dyes are carbocyanine dyes which exhibit J aggregation. Such dyes are characterized by two or more basic heterocyclic nuclei joined by a linkage of three methine groups. The heterocyclic nuclei preferably include fused benzene rings to enhance J aggregation. Preferred heterocyclic nuclei for promoting J aggregation are quinolinium, benzoxazolium, benzothiazolium, benzoselenazolium, benzimidazolium, naphthooxazolium, naphthothiazolium, and naphthoselenazolium quaternary salts.

Specific preferred dyes for use as adsorbed site directors in accordance with this invention are illustrated by the dyes listed below in Table I.

TABLE I

Illustrative Preferred Adsorbed Site Directors

AD-1: Anhydro-9-ethyl-3,3'-bis(3-sulfopropyl)-4,5,4',5'-dibenzothiacarbocyanine hydroxide, AD-2: Anhydro-5,5'-dichloro-9-ethyl-3,3'-bis(3-sulfobutyl)thiacarbocyanine hydroxide AD-3: Anhydro-5,5',6,6'-tetrachloro-1,1'-diethyl-3,3'-bis(3-sulfobutyl)benzimidazolocarbocyanine hydroxide AD-4: Anhydro-5,5',6,6'-tetrachloro-1,1',3-triethyl-3'-(3-sulfobutyl)benzimidazolocarbocyanine hydroxide AD-5: Anhydro-5-chloro-3,9-diethyl-5'-phenyl-3'-(3-sulfopropyl)oxacarbocyanine hydroxide AD-6: Anhydro-5-chloro-3',9-diethyl-5'-phenyl-3-(3-sulfopropyl)oxacarbocyanine hydroxide AD-7: Anhydro-5-chloro-9-ethyl-5'-phenyl-3,3'-bis(3-sulfopropyl)oxacarbocyanine hydroxide AD-8: Anhydro-9-ethyl-5,5'-diphenyl-3,3'-bis(3-sulfobutyl)oxacarbocyanine hydroxide AD-9: Anhydro-5,5'-dichloro-3,3'-bis(3-sulfopropyl)-thiacyanine hydroxide AD-10: 1,1'-Diethyl-2,2'-cyanine p-toluenesulfonate Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering*, Vol. 18, 1974, pp. 49–53 (Sturmer et al.), pp. 175–178 (Leubner) and pp. 475–485 (Gilman). Oxidation and reduction potentials can be measured as described by R. J. Cox, *Photographic Sensitivity*, Academic Press, 1973, Chapter 15.

The chemistry of cyanine and related dyes is illustrated by Weissberger and Taylor, *Special Topics of Heterocyclic Chemistry*, John Wiley and Sons, New York, 1977, Chapter VIII; Venkataraman, *The Chemistry of Synthetic Dyes*, Academic Press, New York, 1971, Chapter V; James, *The Theory of the Photographic Process*, 4th Ed., Macmillan, 1977, Chapter 8, and F. M. Hamer, *Cyanine Dyes and Related Compounds*, John Wiley and Sons, 1964.

Although native blue sensitivity of silver bromide or bromoiodide is usually relied upon in the art in emulsion layers intended to record exposure to blue light, significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes. When the emulsions of the invention are high aspect ratio tabular grain silver bromide and silver bromoiodide emulsions, very large increases in speed are realized by the use of blue spectral sensitizing dyes.

Among useful spectral sensitizing dyes for sensitizing silver halide emulsions are those found in U.K. Pat. No.

742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (U.S. Pat. No. Re. 24,292), 2,778,823, 2,917,516, 3,352,857, 3,411,916 and 3,431,111, Wilmanns et al. U.S. Pat. No. 2,295,276, Sprague U.S. Pat. Nos. 2,481,698 and 2,503,776, Carroll et al. U.S. Pat. Nos. 2,688,545 and 2,704,714, Larive et al. U.S. Pat. No. 2,921,067, Jones U.S. Pat. No. 2,945,763, Nys et al. U.S. Pat. No. 3,282,933, Schwan et al. U.S. Pat. No. 3,397,060, Riester U.S. Pat. No. 3,660,102, Kampfer et al. U.S. Pat. No. 3,660,103, Taber et al. U.S. Pat. Nos. 3,335,010, 3,352,680 and 3,384,486, Lincoln et al. U.S. Pat. No. 3,397,981, Fumia et al. U.S. Pat. Nos. 3,482,978 and 3,623,881, Spence et al. U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al. U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bis-triazinylaminostilbenes, as taught by McFall et al. U.S. Pat. No. 2,933,390; sulfonated aromatic compounds, as taught by Jones et al. U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 percent to 100 percent or more of monolayer coverage of the total available surface area of surface sensitive silver halide grains, as disclosed, for example, in West et al., "The Adsorption of Sensitizing Dyes in Photographic Emulsions", *Journal of Phys. Chem.*, Vol 56, p. 1065, 1952, and Spence et al., "Desensitization of Sensitizing Dyes", *Journal of Physical and Colloid Chemistry*, Vol. 56, No. 6, June 1948, pp. 1090–1103; and Gilman et al. U.S. Pat. No. 3,979,213. Optimum dye concentration levels can be chosen by procedures taught by Mees, *Theory of the Photographic Process*, pp. 1067–1069, cited above.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1−log E), where E is measured in meter-candle-seconds at a density of 0.1 above fog.

Once emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

The photographic elements of this invention are preferably forehardened as described in *Research Disclosure*, Vol. 176, December 1978, Item 17643, Paragraph X, here incorporated by reference. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure*, Vol. 184, August 1979, Item 18431, Paragraph K, relating particularly to the processing of radiographic materials.

The present invention is equally applicable to photographic elements intended to form negative or positive images. For example, the photographic elements can be of a type which form either surface or internal latent images on exposure and which produce negative images on processing. Alternatively, the photographic elements can be of a type that produce direct positive images in response to a single development step. When the composite grains comprised of the host grain and the silver salt epitaxy form an internal latent image, surface fogging of the composite grains can be undertaken to facilitate the formation of a direct positive image. In a specifically preferred form the silver salt epitaxy is chosen to itself form an internal latent image site (i.e., to internally trap electrons) and surface fogging can, if desired, be limited to just the silver salt epitaxy. In another form the host grain can trap electrons internally with the silver salt epitaxy preferably acting as a hole trap. The surface fogged emulsions can be employed in combination with an organic electron acceptor as taught, for example, by Kendall et al. U.S. Pat. No. 2,541,472, Shouwenaars U.K. Pat. No. 723,019, Illingsworth U.S. Pat. Nos. 3,501,305, '306, and '307, *Research disclosure*, Vol, 134, June, 1975, Item 13452, Kurz U.S. Pat. No. 3,672,900, Judd et al. U.S. Pat. No. 3,600,180, and Taber et al. U.S. Pat. No. 3,647,643. The organic electron acceptor can be employed in combination with a spectrally sensitizing dye or can itself be a spectrally sensitizing dye, as illustrated by Illingsworth et al. U.S. Pat. No. 3,501,310. If internally sensitive emulsions are employed, surface fogging and organic electron acceptors can be employed in combination as illustrated by Lincoln et al. U.S. Pat. No. 3,501,311, but neither surface fogging nor organic electron acceptors are required to produce direct positive images.

In addition to the specific features described above, the photographic elements of this invention can employ conventional features, such as disclosed in *Research Disclosure*, Item 17643 cited above and here incorporated by reference. Optical brighteners can be introduced, as disclosed by Item 17643 at Paragraph V. Antifoggants and stabilizers can be incorporated, as disclosed by Item 17643 at Paragraph VI. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the emulsions of the present invention with each other or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the emulsions of this invention can be blended with conventional silver halide emulsions, such as those described in Item 17643, cited above, Paragraph I. It is specifically contemplated to blend the emulsions as described in sub-paragraph F of Paragraph I.

In their simplest form photographic elements according to the present invention employ a single silver halide emulsion layer containing an emulsion according to the present invention and a photographic support. It is, of course, recognized that more than one silver halide emulsion layer as well as overcoat, subbing, and interlayers can be usefully included. Instead of blending emulsions as described above the same effect can usually by achieved by coating the emulsions as separate layers. Coating of separate emulsion layers to achieve exposure latitude is well known in the art, as illustrated by Zelikman and Levi, *Making and Coating Photographic Emulsions,* Focal Press, 1964, pp. 234–238; Wyckoff U.S. Pat. No. 3,663,228; and U.K. Pat. No. 923,045. It is further well known in the art that increased photographic speed can be realized when faster and slower silver halide emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface. Typical of useful paper and polymeric film supports are those disclosed in *Research Disclosure,* Item 17643, cited above, Paragraph XVII.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application No. W080/01614, published Aug. 7, 1980, (Belgian Pat. No. 881,513, Aug. 1, 1980, corresponding), Blazey et al. U.S. Pat. No. 4,307,165, and Gilmour et al. U.S. Pat. No. 4,411,973, here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure,* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography—Materials, Processes and Systems,* VanNostrand Reinhold Company, 7th Ed., 1977.

Included among the processing methods are web processing, as illustrated by Tregillus et al. U.S. Pat. No. 3,179,517; stabilization processing, as illustrated by Herz et al. U.S. Pat. No. 3,220,839, Cole U.S. Pat. No.

3,615,511, Shipton et al. U.K. Pat. No. 1,258,906 and Haist et al. U.S. Pat. No. 3,647,453; monobath processing as described in Haist, *Monobath Manual,* Morgan and Morgan, Inc., 1966, Schuler U.S. Pat. No. 3,240,603, Haist et al. U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al. U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al. U.S. Pat. No. 3,232,761; roller transport processing, as illustrated by Russell et al. U.S. Pat. Nos. 3,025,779 and 3,515,556, Masseth U.S. Pat. No. 3,573,914, Taber et al. U.S. Pat. No. 3,647,459 and Rees et al. U.K. Pat. No. 1,269,268; alkaline vapor processing, as illustrated by *Product Licensing Index,* Vol. 97, May 1972, Item 9711, Goffe et al. U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; reversal processing, as illustrated by Henn et al. U.S. Pat. No. 3,576,633; and surface application processing, as illustrated by Kitze U.S. Pat. No. 3,418,132.

Once a silver image has been formed in the photographic element, it is conventional practice to fix the undeveloped silver halide. The high aspect ratio tabular grain emulsions of the present invention are particularly advantageous in allowing fixing to be accomplished in a shorter time period. This allows processing to be accelerated.

The photographic elements and the techniques described above for producing silver images can be readily adapted to provide a colored image through the selective destruction, formation, or physical removal of dyes, such as described in *Research Disclosure,* Item 17643, cited above, Paragraph VII, Color materials. Processing of such photographic elements can take any convenient form, such as described in Paragraph XIX, Processing.

The present invention can be employed to produce multicolor photographic images merely by adding or substituting an emulsion according to the present invention. The present invention is fully applicable to both additive multicolor imaging and subtractive multicolor imaging.

To illustrate the application of this invention to additive multicolor imaging, a filter array containing interlaid blue, green, and red filter elements can be employed in combination with a photographic element according to the present invention capable of producing a silver image. An emulsion of the present invention which is panchromatically sensitized and which forms a layer of the photographic element is imagewise exposed through the additive primary filter array. After processing to produce a silver image and viewing through the filter array, a multicolor image is seen. Such images are best viewed by projection. Hence both the photographic element and the filter array both have or share in common a transparent support.

Significant advantages can be realized by the application of this invention to multicolor photographic elements which produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively. Although only one radiation-sensitive emulsion according to the present invention is required, the multicolor photographic element contains at least three separate emulsions for recording blue, green, and red light, respectively. The emulsions other than the required emulsion according to the present invention can be of any convenient conventional form. Various conventional emulsions are illustrated by *Research Disclosure,* Item 17643, cited above, Paragraph I, Emulsion preparation and types, here incorporated by reference. In a preferred form of the invention all of the emulsion layers contain silver bromide or bromoiodide host grains. In a particularly preferred form of the invention at least one green recording emulsion layer and at least one red recording emulsion layer is comprised of an emulsion according to this invention. It is, of course, recognized that all of the blue, green, and red recording emulsion layers of the photographic element can advantageously be emulsions according to the present invention, if desired, although this is not required for the practice of this invention.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al. U.S. Pat. No. 2,937,086 and/or in interlayers between adjacent color-forming layer units, as illustrated by Weissberger et al. U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

The multicolor photographic elements of this invention can take any convenient form consistent with the requirements indicated above. Any of the six possible layer arrangements of Table 27a, p. 211, disclosed by Gorokhovskii, *Spectral Studies of the Photographic Process,* Focal Press, New York, can be employed. It is most common for multicolor photographic elements to locate a blue recording yellow dye image providing color forming layer unit nearest the exposing radiation source followed by a green recording magenta dye image providing color providing layer unit and a red recording cyan dye image providing color providing layer unit in that order. Where both faster and slower red and green recording layer units are present, variant layer order arrangements can be beneficial, as taught by Eeles et al. U.S. Pat. No. 4,184,876, Ranz et al. German OLS No. 2,704,797, and Lohmann et al. German OLS Nos. 2,622,923, 2,622,924, and 2,704,826.

By employing silver halide emulsions of limited iodide content according to the present invention for recording green or red light exposures in multicolor photographic elements significant advantages are realized as compared to the use of silver bromoiodide emulsions containing higher levels of iodide, as required by Koitabashi et al., cited above, for example. By increasing the level of iodide in the emulsions the native sensitivity of the emulsions to blue light is increased, and the risk of color falsification in recording green or red exposures is thereby increased. In constructing muilticolor photographic elements color falsification can be analyzed as two distinct concerns. The first concern is the difference between the blue speed of the green or red recording emulsion layer and its green or red speed. The second concern is the difference between the blue speed of each blue recording emulsion layer and the blue speed of the corresponding green or red recording emulsion layer. Generally in preparing a multicolor photographic element intended to record accurately image colors under daylight exposure conditions (e.g., 5500° K.) the aim is to achieve a difference of about an order of magnitude between the blue speed of each blue recording emulsion layer and the blue speed of the corresponding green or red recording emulsion layer. The present invention offers a distinct advantage over Koitabashi et al. in achieving such aim speed spearations.

EXAMPLES

The invention is further illustrated by the following examples. In each of the examples the contents of the reaction vessel were stirred vigorously throughout the silver and halide salt introductions; the term "percent" means percent by weight, unless otherwise indicated; and the term "M" stands for a molar concentration, unless otherwise stated. All solutions, unless otherwise stated, are aqueous solutions.

EXAMPLE 1

This example illustrates nonselective and selective deposition of silver chloride on a silver bromoiodide host emulsion containing 9 mole percent iodide and consisting largely of thick platelets.

EMULSION 1A

Host Silver Bromoiodide Emulsion Containing 9 Mole Percent Iodide

The host emulsion for Example 1 was a silver bromoiodide (9 mole percent iodide) polydisperse emulsion of average grain size 1.6 μm made up largely of thick plates showing predominantly {111} faces. It was prepared by a double-jet nucleation at 80° C., followed by a triple jet growth addition of silver nitrate, potassium bromide and potassium iodide employing accelerated flow at 80° C. The final gelatin content was 40 g/Ag mole. A carbon replica electron micrograph is shown in FIG. 1.

EMULSION 1B

Nonselective AgCl Epitaxial Growth

Figure 2:
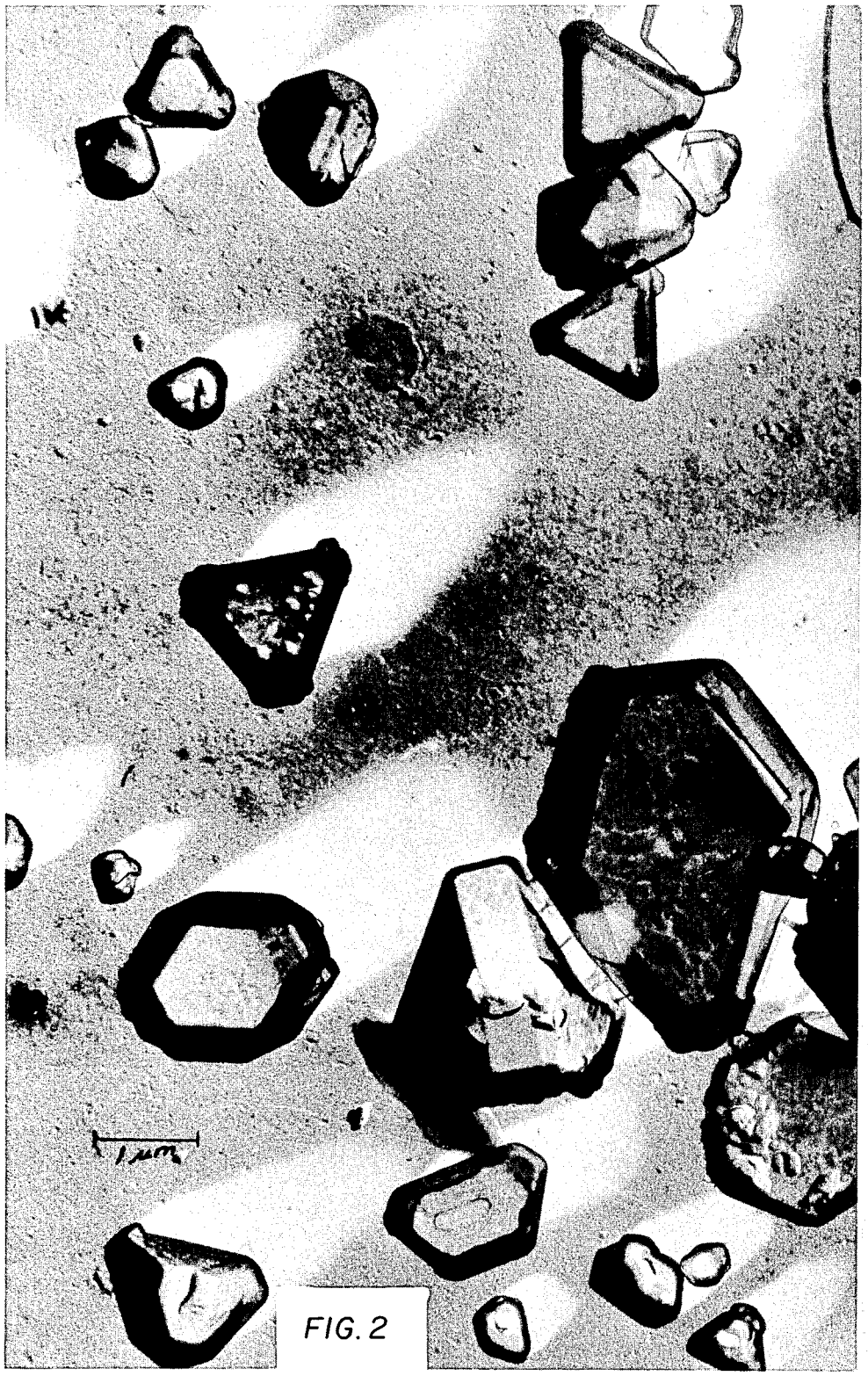

The host emulsion 1A diluted to 1 kg/Ag mole was adjusted to pAg 7.2 at 40° C. by the simultaneous addition of 0.1 M $AgNO_3$ and 0.009 M KI. Then a 0.74M NaCl solution was added to make the emulsion $1.85\times10^{-2}$M in chloride. Then onto 0.04 mole of the emulsion was precipitated 1.25 mole percent AgCl by double-jet addition for 2.0 minutes using 0.34M NaCl and 0.25M $AgNO_3$ solutions, while maintaining the pAg of 7.5 at 40° C. Fifteen seconds after the start of the AgCl precipitation, 1 mg/Ag mole of sodium thiosulfate and 1 mg/Ag mole of $KAuCl_4$ were added. The emulsion was then spectrally sensitized with 0.2 millimole/Ag mole of anhydro-5-chloro-9-ethyl-5'-phenyl-3,3'-di(3-sulfopropyl)oxacarbocyanine hydroxide, sodium salt (Dye A). FIG. 2 is an electron micrograph showing the non-selective epitaxial deposition of AgCl.

EMULSION 1C

Corner and Edge-Directed Epitaxy

Figure 3:
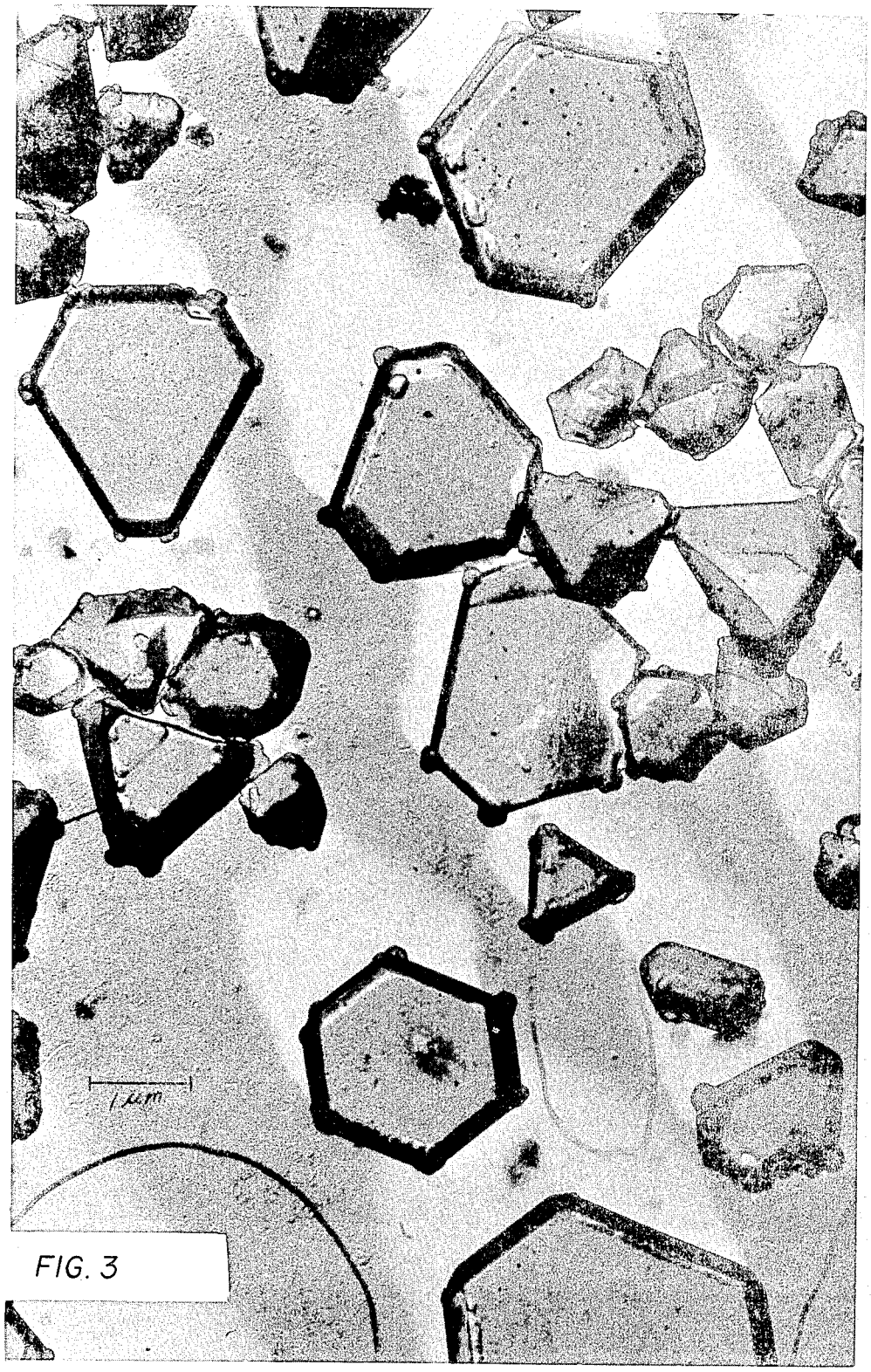

This epitaxial emulsion was prepared identically to Emulsion 1B, except that the spectral sensitizing dye was added before the precipitation of the AgCl phase. FIG. 3 is an electron micrograph showing corner and edge epitaxy.

EXAMPLE 1 COATINGS

The following coatings of the emulsions of Example 1 were made on cellulose acetate support at 4.3 g/m$^2$ Ag, 6.46 g/m$^2$ gelatin, 0.3 g/m$^2$ saponin, and were hardened with 0.7 percent bis(vinylsulfonylmethyl) ether based on the weight of gelatin. In addition, coatings 3 and 4 contained 0.068 g/m$^2$ NaCl. The coatings were exposed for 1/10 second to a 600W, 5500° K. tungsten light source (Eastman 1B Sensitometer) through a graded density tablet and processed for 6 minutes using an N-methyl-p-aminophenol sulfate-hydroquinone developer at 20° C. Speed values were determined at 0.3 density units above fog, and are given as Log Speed, 100(1 − Log E), where E is exposure measured in meter-candle-seconds.

Coating 1

Host Emulsion, Spectrally Sensitized

Host emulsion 1A was spectrally sensitized by the addition of 0.2 millimole/Ag mole of Dye A.

Coating 2

Host Emulsion, Chemically and Spectrally Sensitized

Host emulsion 1A was chemically sensitized by the addition of 1 mg/Ag mole of sodium thiosulfate and 1 mg/Ag mole of $KAuCl_4$. The emulsion was heated for 20 minutes at 65° C., cooled to 40° C. and spectrally sensitized by the addition of 0.2 millimole/Ag mole of Dye A.

Coating 3

Non-directed Epitaxy, Chemically and Spectrally Sensitized

A coating of Emulsion 1B.

Coating 4

Directed Epitaxy, Chemically and Spectrally Sensitized

A coating of Emulsion 1C.

EXAMPLE 1 COATING RESULTS

| Coating No. | Log Speed | Gamma | Fog | Dmax |
|---|---|---|---|---|
| 1 | * | — | 0.05 | 0.22 |
| 2 | 159 | 0.30 | 0.06 | 0.55 |
| 3 | 212 | 0.59 | 0.07 | 0.86 |
| 4 | 252 | 0.33 | 0.08 | 0.77 |

*Insufficient developed density to measure speed

Coating 4, consisting of the chemically and spectrally sensitized controlled epitaxy emulsion, has the highest photographic speed.

EXAMPLE 2

This example illustrates nonselective and selective deposition of silver chloride on an octahedral grain silver bromide emulsion.

EMULSION 2A

Host Silver Bromide Emulsion

Figure 4:
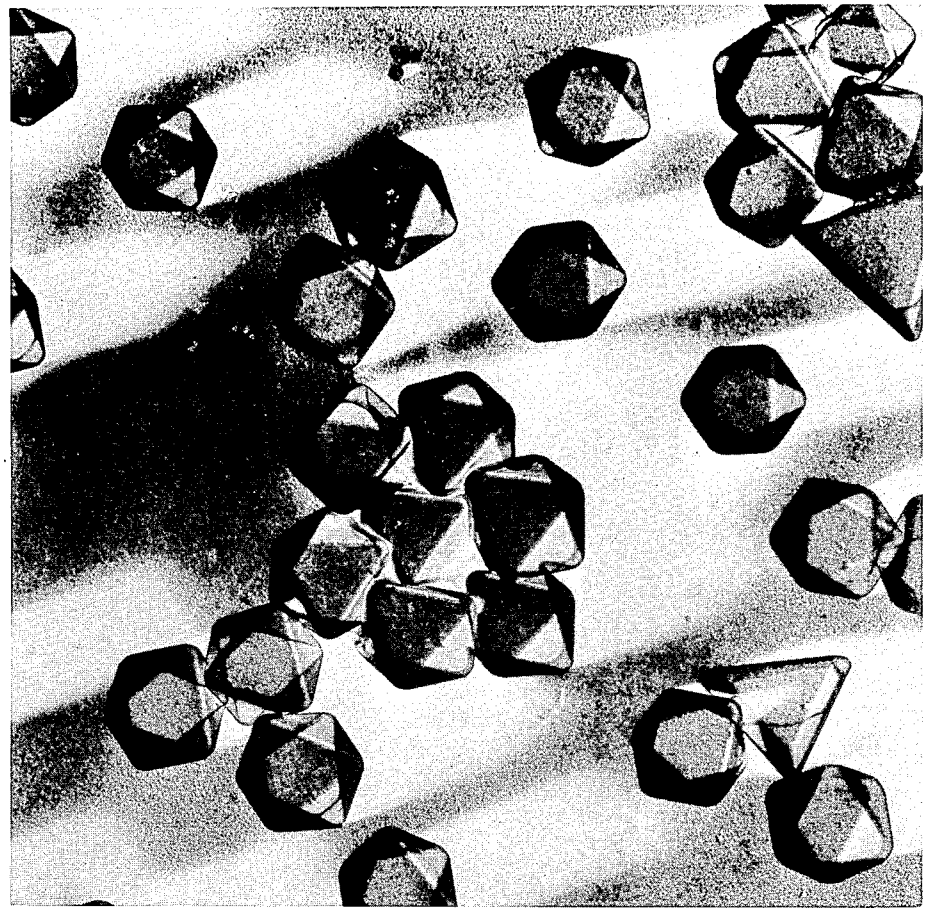

The host emulsion for Example 2 was a monodisperse octahedral silver bromide emulsion of average grain size 1.0 μm prepared by double-jet addition under controlled pAg conditions. Nucleation was at 90° C., followed by growth using accelerated flow at 70° C. The final gelatin content was 12 g/Ag mole. An electron micrograph of Emulsion 2A is shown in FIG. 4.

EMULSION 2B

Nonselective AgCl Epitaxial Growth

Figure 5:
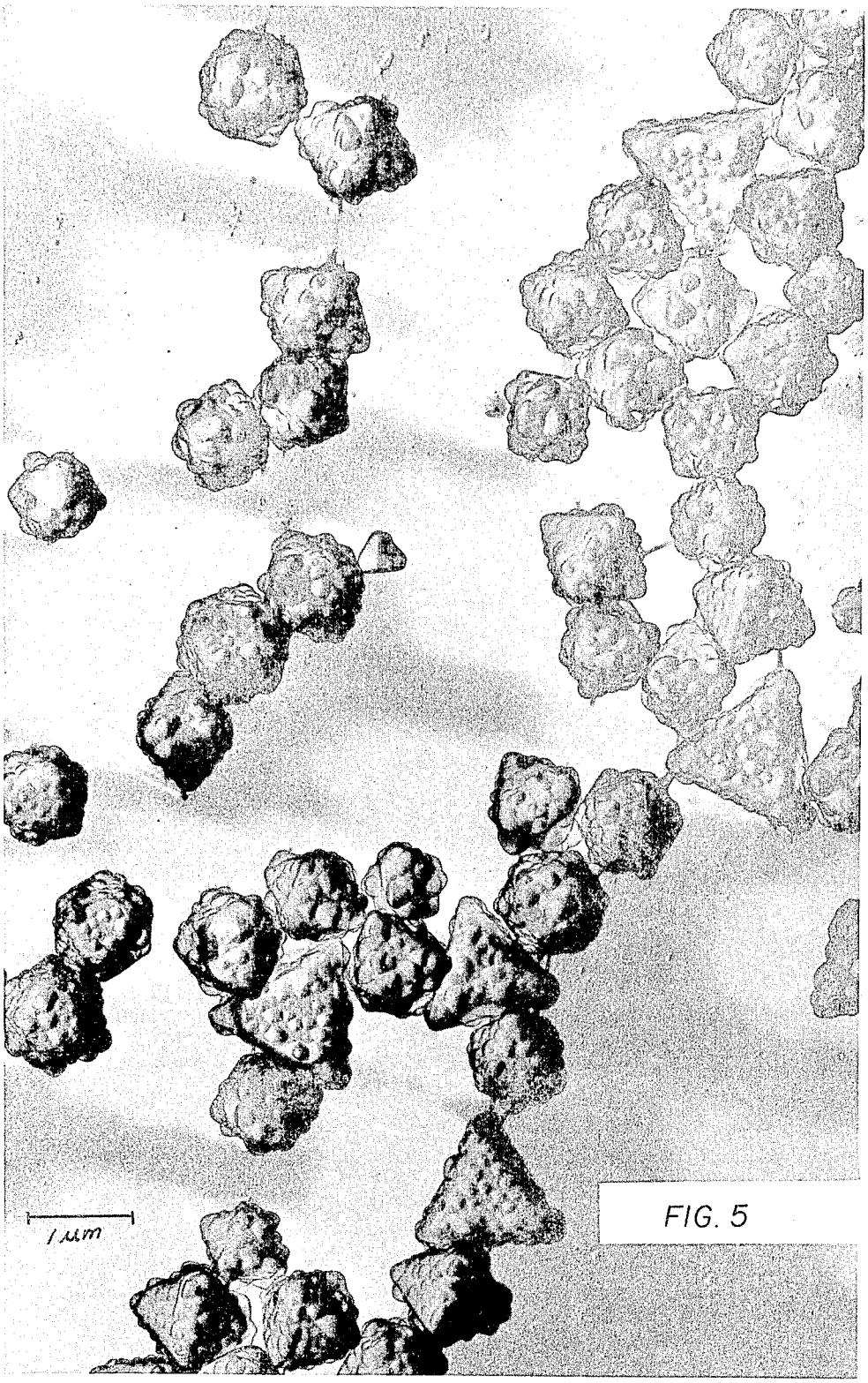

The host emulsion 2A diluted to 1 kg/Ag mole was adjusted to pAg 7.2 at 40° C. by the addition of 0.1M $AgNO_3$. Then a 0.5M NaCl solution was added to make the emulsion $1.25\times10^{-2}$M in chloride. Then onto 0.04M of the emulsion was precipitated 5.0 mole percent AgCl by double jet addition for 8 minutes using 0.52M NaCl and 0.5M $AgNO_3$ solutions, while maintaining the pAg of 7.2 at 40° C. FIG. 5 is an electron micrograph showing the non-selective epitaxial deposition of AgCl.

EMULSION 2C

Selective AgCl Epitaxial Growth

Figure 6:
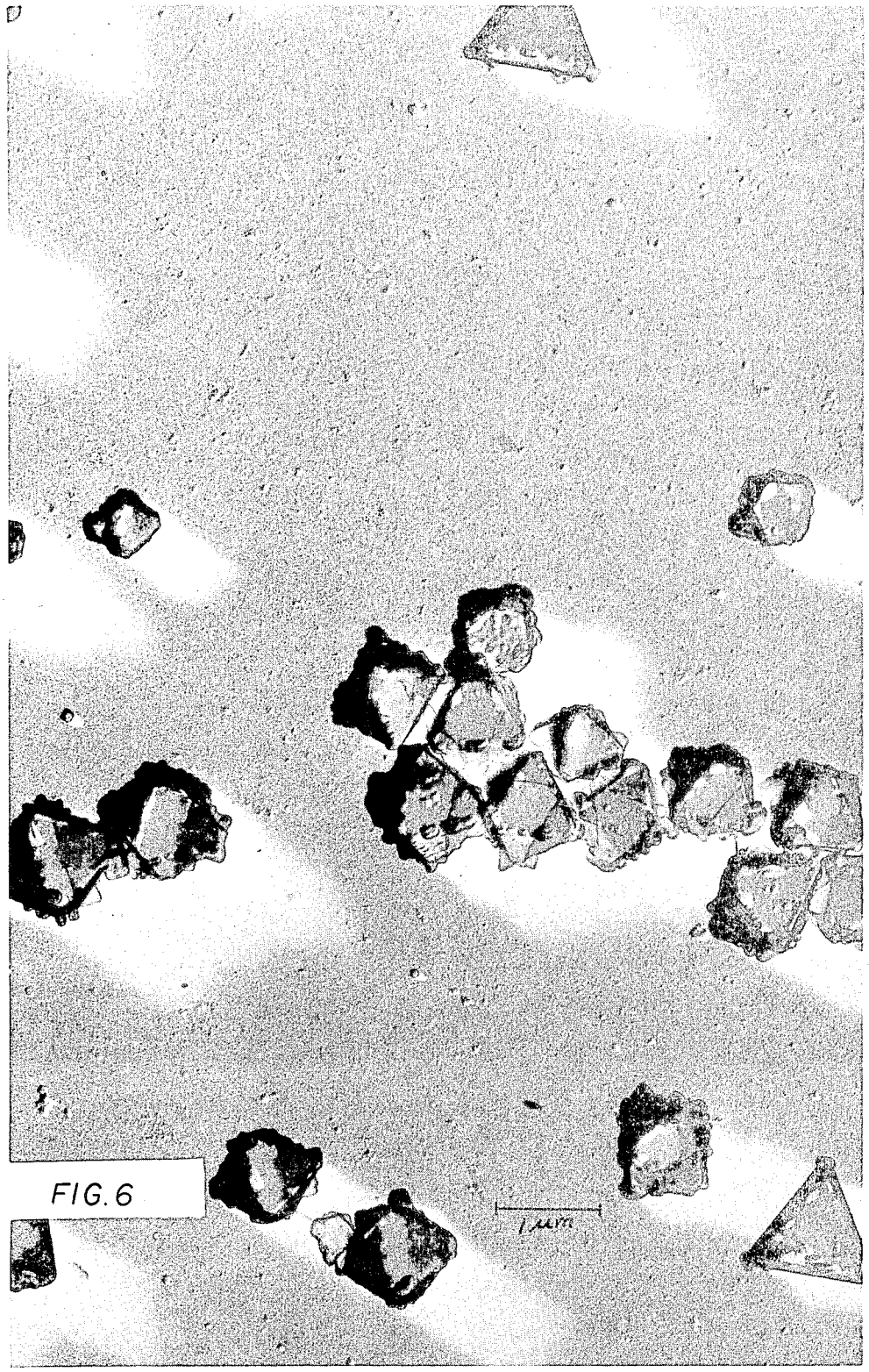

Emulsion 2C was prepared identically to Emulsion 2B except that 1.2 millimole/mole Ag of the spectral sensitizing dye anhydro-5,5',6,6'-tetrachloro-1,1'-diethyl-3,3'-di(3-sulfobutyl)benzimidazolocarbocyanine hydroxide (Dye B) was added immediately after the pAg adjustment and before the epitaxial growth of AgCl. FIG. 6 is an electron micrograph showing selective epitaxial growth predominantly on the edges and corners of the octahedral host AgBr grains.

EMULSION 2D

Selective AgCl Epitaxial Growth

Figure 7:
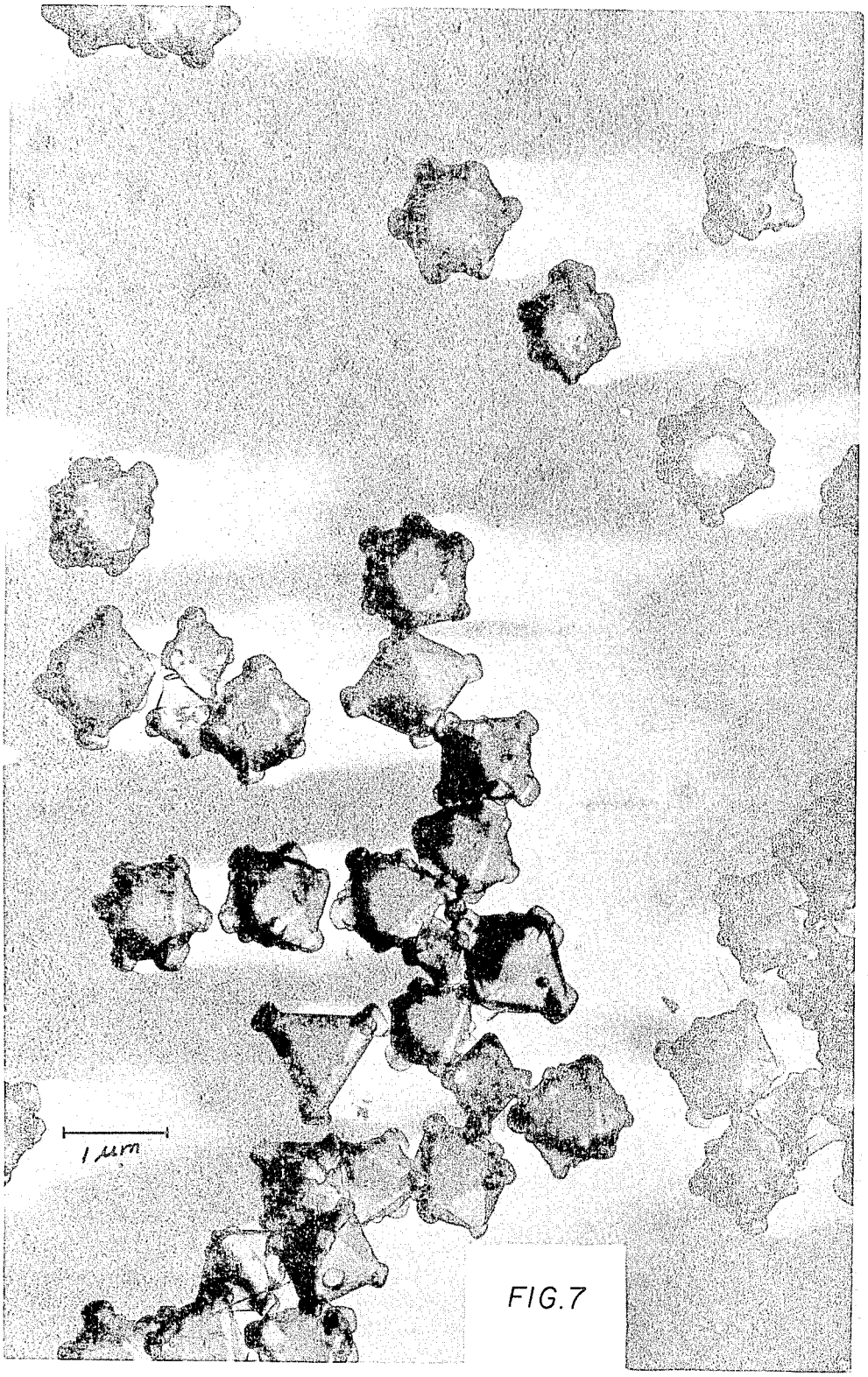

Emulsion 2D was prepared identically to Emulsion 2C except that as spectral sensitizing dye 0.5 millimole/mole Ag of 1,1'-diethyl-2,2'-cyanine p-toluenesulfonate (Dye C) was used. FIG. 7 is an electron micrograph showing selective epitaxial growth predominantly on the corners and edges of the host grains.

EXAMPLE 3

This example illustrates directed epitaxial deposition of AgCl onto an octahedral AgBrI (6 mole percent I) emulsion. The directed epitaxial growth permits a chemical sensitization which provides both high speed and good keeping stability.

EXAMPLE 3A

Host Octahedral Silver Bromoiodide Emulsion, 6 Mole percent I

Figure 8:
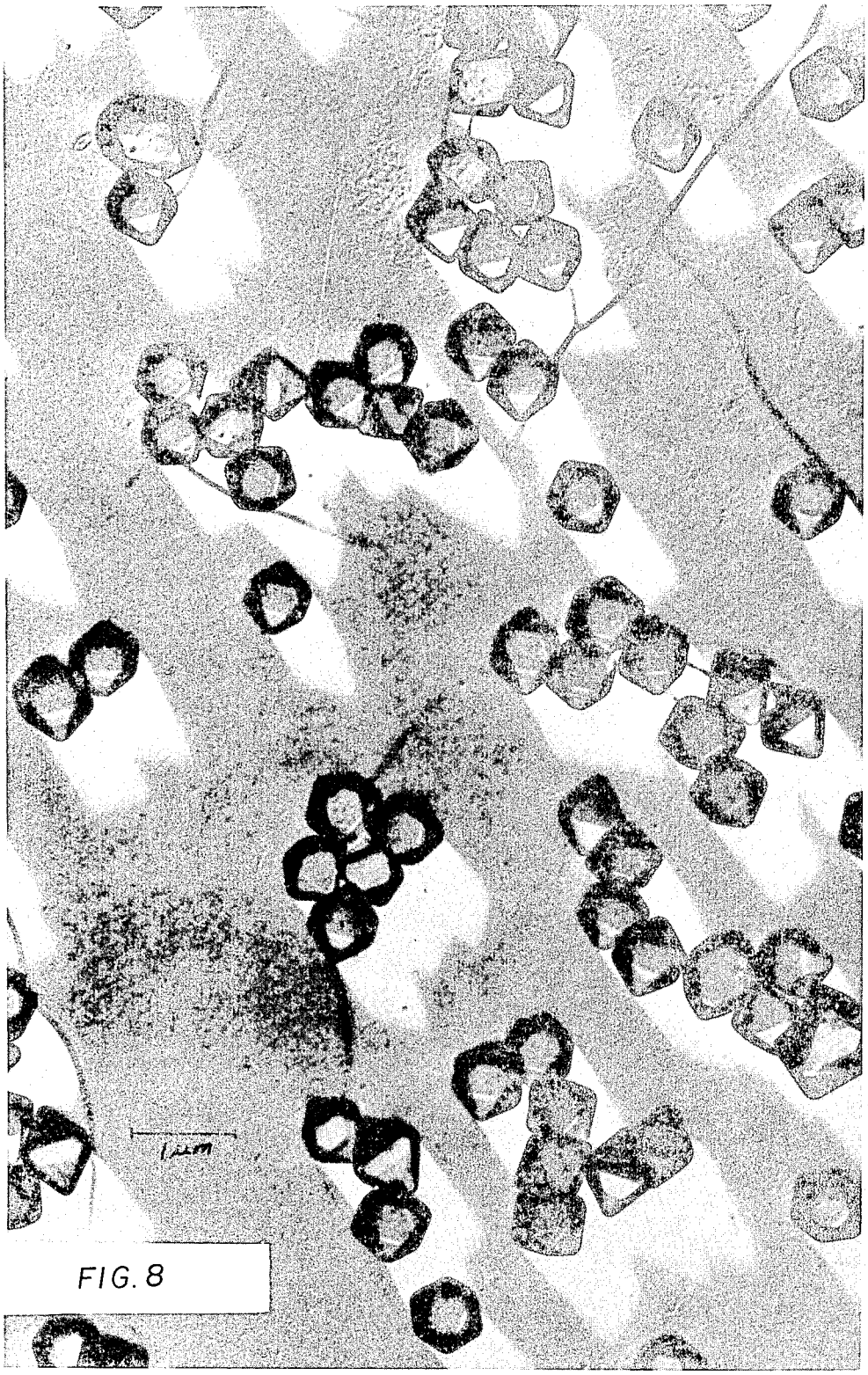

The host emulsion for Example 3 was a monodisperse octahedral bromoiodide emulsion (6 percent I) of average grain size 0.8 μm prepared by a controlled pAg double jet precipitation. Nucleation was at 90° C., followed by growth using accelerated flow at 70° C. The final gelatin content was 40 g/Ag mole. An electron micrograph of Emulsion 3A is shown in FIG. 8.

EMULSION 3B

Corner Directed Epitaxy

Figure 9:
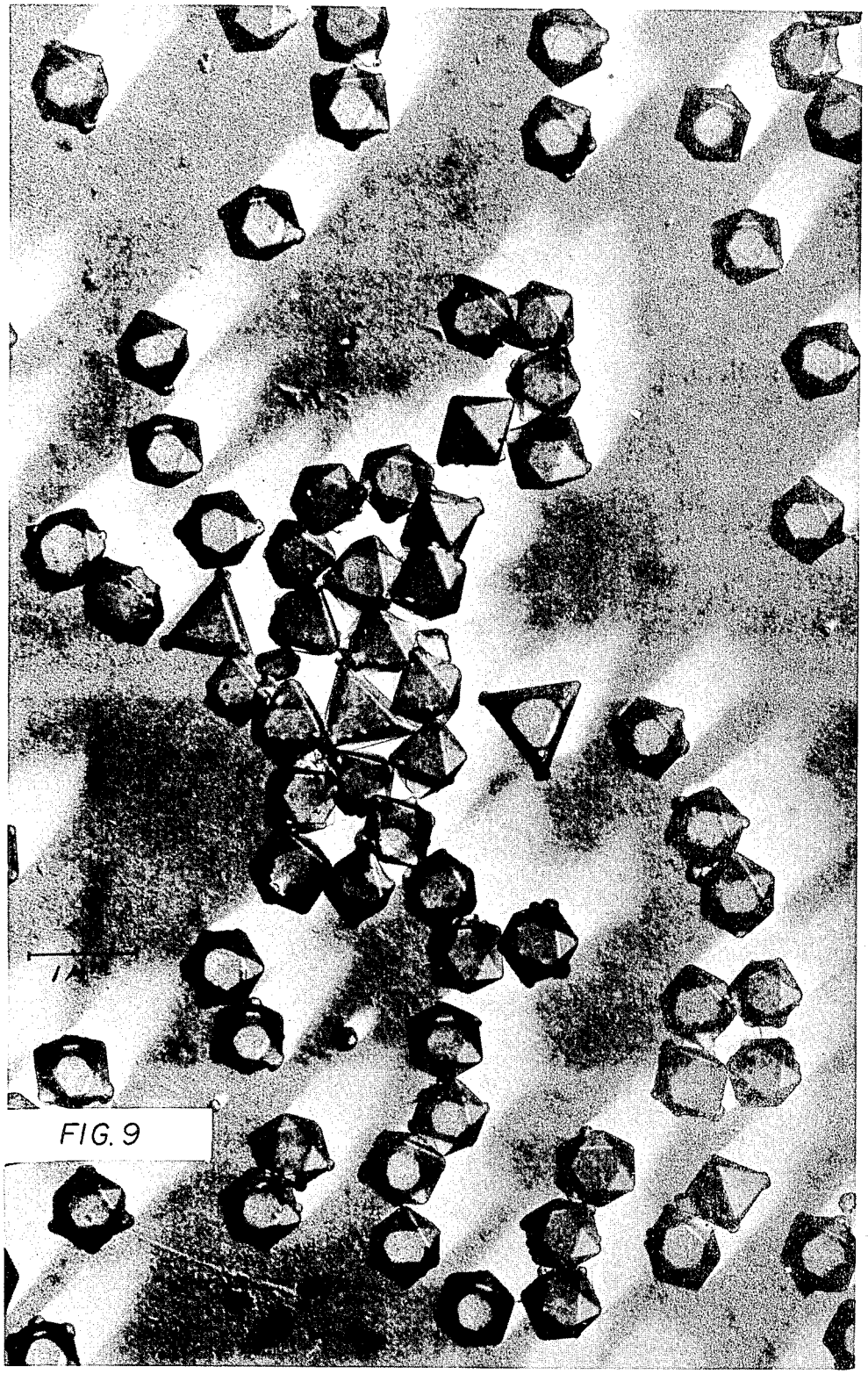

The host emulsion 3A diluted to 1 kg/Ag mole was adjusted to pAg 7.2Z at 40° C. by the simultaneous addition of 0.1M $AgNO_3$ and 0.006M KI. Then a 0.74M NaCl solution was added to make the emulsion $1.85\times10^{-2}$M in chloride. The emulsion was then spectrally sensitized with 0.72 millimole/Ag mole of Dye A and held for 30 minutes with stirring. Then onto 0.04 mole of the emulsion was precipitated 1.25 mole percent AgCl by double-jet addition for 2.0 minutes using 0.55M NaCl and 0.5M $AgNO_3$ solutions, while maintaining the pAg at 7.5 at 40° C. Fifteen seconds after the start of the AgCl precipitation, 1 mg/Ag mole of sodium thiosulfate and 1 mg/Ag mole of $KAuCl_4$ were added. FIG. 9 is an electron micrograph showing the corner-directed epitaxial deposition of AgCl.

EXAMPLE 3 COATINGS

The following coatings of the emulsion of Example 3 were made on cellulose ester support at 1.5 g/m$^2$Ag, 3.6 g/m$^2$ gelatin, and 0.007 g/m$^2$ saponin. A protective overcoat layer containing 0.5 g/m$^2$ gelatin was also applied. The coatings were exposed and processed similarly to those of Example 1 except that the exposing source was at 2850° K. Additional samples were kept for 1 week at 49° C., 50 percent relative humidity and then exposed and processed.

Coating 1

Chemically and Spectrally Sensitized Host Emulsion

The host emulsion 3A was conventionally chemically sensitized with 3 mg/Ag mole sodium thiosulfate and 3 mg/Ag mole $KAuCl_4$, then spectrally sensitized with 0.72 millimole/Ag mole of Dye A.

Coating 2

Chemically and Spectrally Sensitized Host Emulsion with Addition of Thiocyanate

The host emulsion was chemically and spectrally sensitized as for Coating 1, except that 800 mg/Ag mole of sodium thiocyanate was added along with the sulfur and gold sensitizers to obtain a sensitization optimum for photographic speed.

Coating 3

Directed Epitaxy, Chemically and Spectrally Sensitized

A coating of Emulsion 3B.

EXAMPLE 3 COATING RESULTS

| Coating No. | Log Speed | Gamma | Fog | Dmax |
|---|---|---|---|---|
| 1 Fresh | 219 | .50 | .11 | .99 |
| Keeping | 180 | .34 | .12 | .92 |
| 2 Fresh | 307 | .71 | .11 | 1.15 |
| Keeping | 214 | .19 | .81 | 1.10 |
| 3 Fresh | 303 | .45 | .13 | 1.03 |
| Keeping | 302 | .42 | .26 | .97 |

The control coating of the conventionally chemically and spectrally sensitized host emulsion was low in photographic speed. Addition of thiocyanate to the chemical sensitization provided greatly increased speed, but poor keeping stability. The spectrally and chemically sensitized directed epitaxial emulsion provided both high speed and good keeping stability.

EXAMPLE 4

Example 4 illustrates directed epitaxial deposition of AgCl onto an octahedral AgBr emulsion. The epitaxial deposition is directed by means of a prior addition of soluble iodide.

EMUSLION 4A

Host Octahedral Silver Bromide Emulsion

Figure 10:
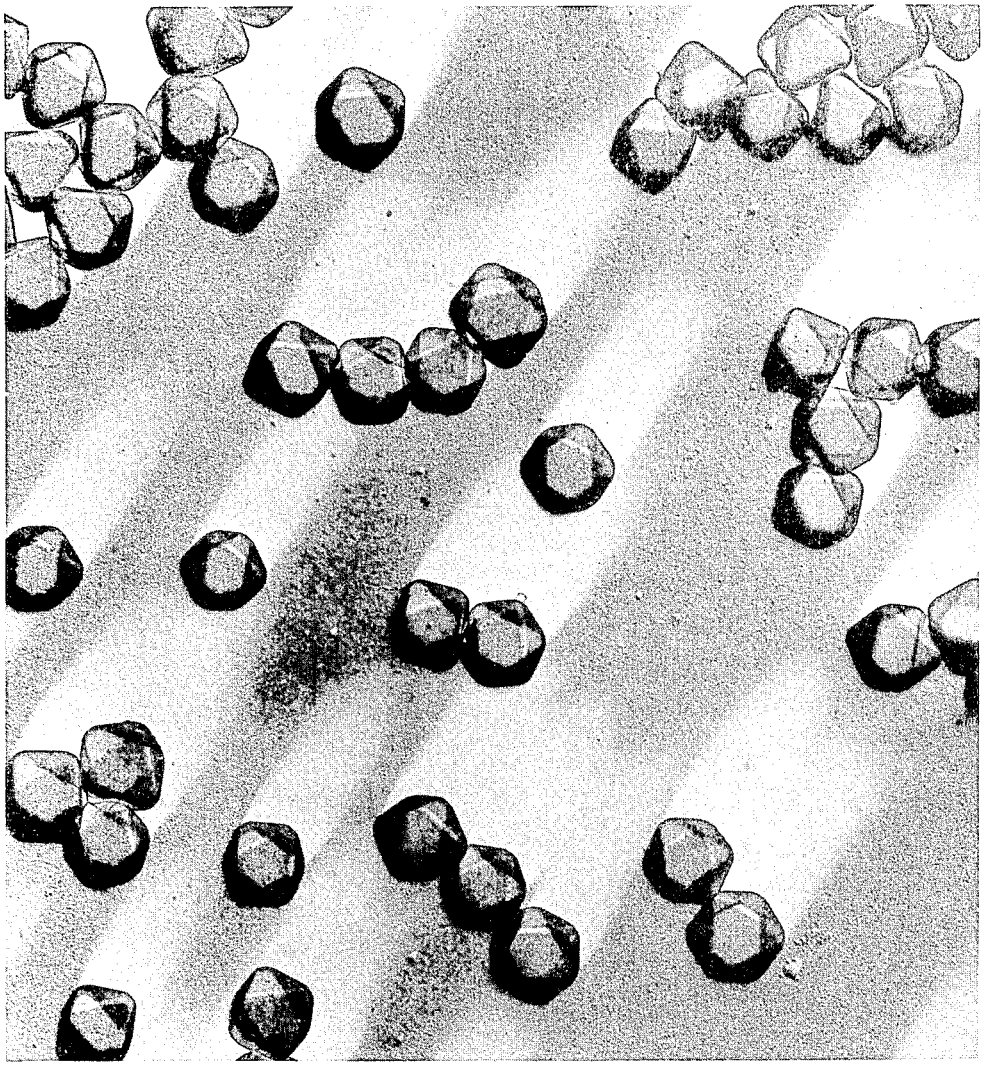

The host emulsion for Example 4 was a monodisperse octahedral silver bromide emulsion of average grain size approximately 0.8 μm prepared by double-jet runs under controlled pAg conditions. Nucleation was at 85° C., followed by growth at the same temperature using accelerated flow. Final gelatin content was 40 g/Ag mole. An electron micrograph of Emulsion 4A is shown in FIG. 10.

EMULSION 4B

Non-selective AgCl Epitaxial Growth

Figure 11:
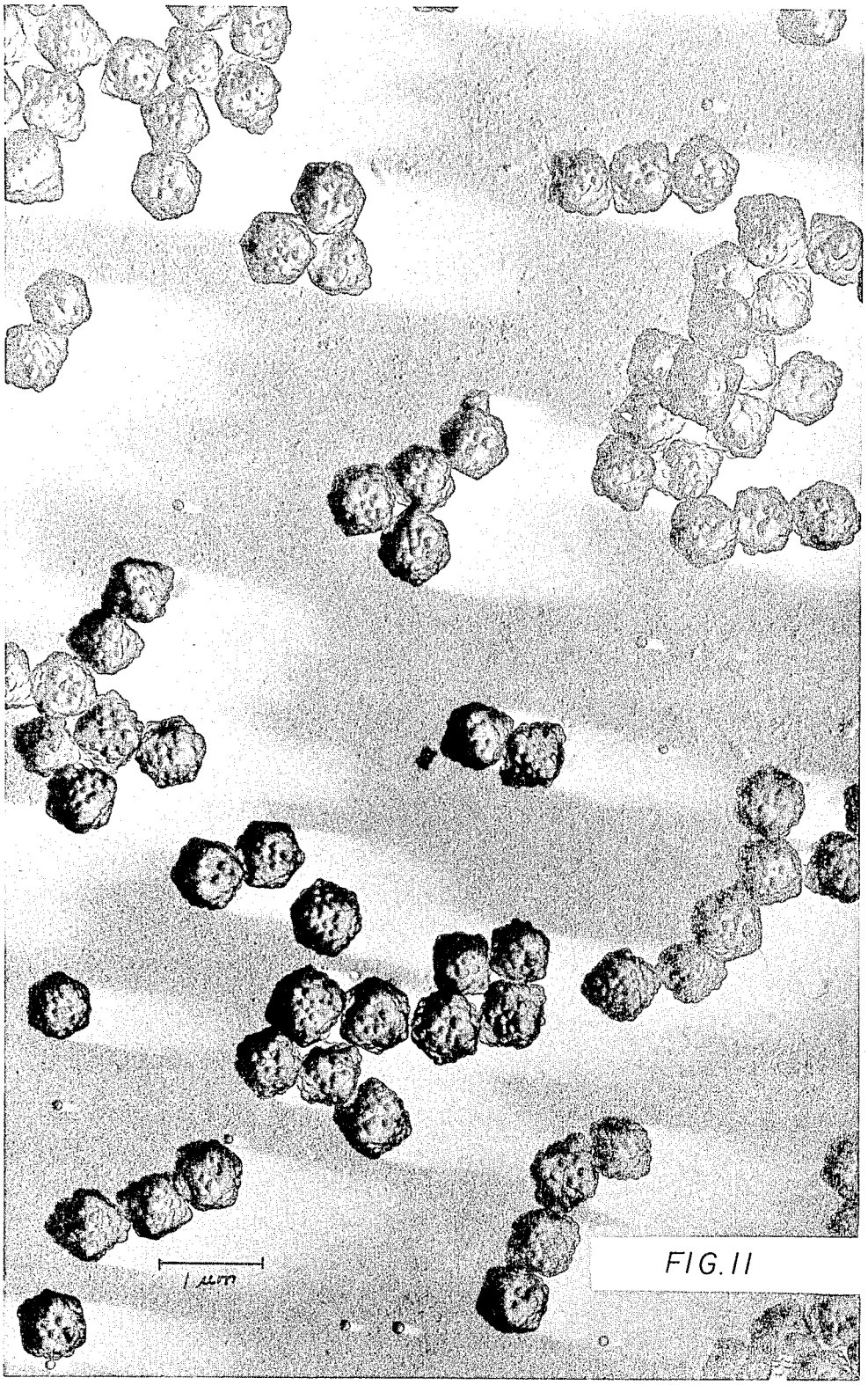

The host emulsion 4B was diluted to 1 kg/Ag mole. A 0.04 mole Ag portion was heated to 40° C. for 30 minutes, then centrifuged. The precipitate was made up to 40 g with $1.84\times10^{-2}$M NaCl. Onto the emulsion was precipitated 5.0 mole percent AgCl by double-jet addition for 8 minutes using 0.55M NaCl and 0.5M $AgNO_3$ solutions, while maintaining a pAg of 7.5 at 40° C. FIG. 11 is an electron micrograph showlng the non-selective epitaxial deposition of AgCl.

EMULSION 4C

Corner-Directed AgCl Epitaxial Growth

Figure 12:
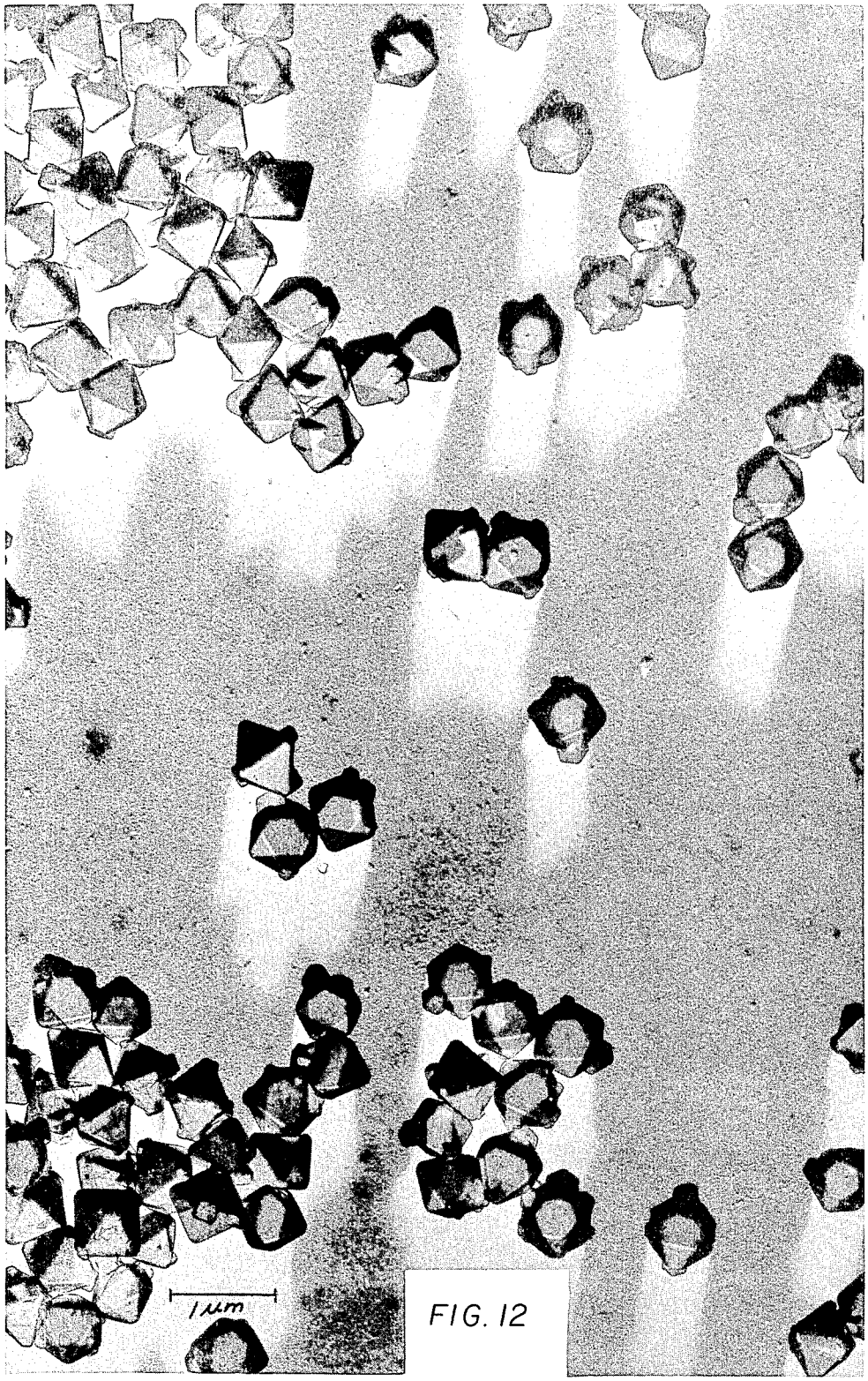

Emulsion 4C was prepared identically to Emulsion 4B except that 10 cc of a $4.0\times10^{-2}$M solution of KI was slowly added prior to the 30 minute, 40° hold step (1 mole percent iodide). FIG. 12 is a electron micrograph showing the subsequent corner-directed deposition of AgCl.

The following examples, common to Maskasky U.S. Ser. No. 431,855, cited above, illustrate controlled epitaxial deposition onto high aspect ratio tabular silver halide host grains which are in each instance bounded by {111} major crystal faces.

COMPARATIVE EXAMPLE 5

This example illustrates the nonselective epitaxial deposition of silver chloride on a tabular grain AgBrI emulsion containing 6 mole % iodide and not previously spectrally sensitized.

EMULSION 5A

Tabular Grain AgBrI (6mole % iodide) Host

To 6.0 liters of a 1.5% gelatin solution containing 0.12M potassium bromide at 55° C. were added with stirring and by double-jet, a 2.0 molar KBr solution containing 0.12 molar KI and a 2.0 molar $AgNO_3$ solution over an eight minute period while maintaining the pBr of 0.92 (consuming 5.3% of the total silver used). The bromide and silver solutions were then run concurrently maintaining pBr 0.92 in an accelerated flow (6.0X from start to finish—i.e., six times faster at the end than at the start) over 41 minutes (consuming 94.7% of the total silver used). A total of 3.0 moles of silver was used. The emulsion was cooled to 35° C., washed by the coagulation method of U.S. Pat. No. 2,614,929 of Yutzy and Russell, and stored at pAg 7.6 measured at 40° C. The resultant tabular grain AgBrI (6 mole % iodide) emulsion had an average grain diameter of 3.0 μm, an average thickness of 0.09 μm, an average aspect ratio of 33:1, and 85% of the grains were tabular based on projected area.

EMULSION 5B

Major Crystal Face AgCl Epitaxial Growth 40 g of the tabular grain AgBrI Emulsion 1A (0.04 mole) prepared above was adjusted to pAg 7.2 at 40° C. with a 0.1 molar $AgNO_3$ solution. 1.0 ml of a 0.79 molar NaCl solution was added. Then the double-jet addition for 8.3 minutes of 0.54 molar NaCl and 0.5 molar $AgNO_3$ solutions while maintaining the pAg at 7.5 at 40° C. resulted in the epitaxial deposition of AgCl in the amount of 5 mole % of the total silver halide. For succinctness this emulsion is referred as a 5 mole % AgCl emulsion, and similar terminology is applied to subsequent emulsions.

Figure 13:
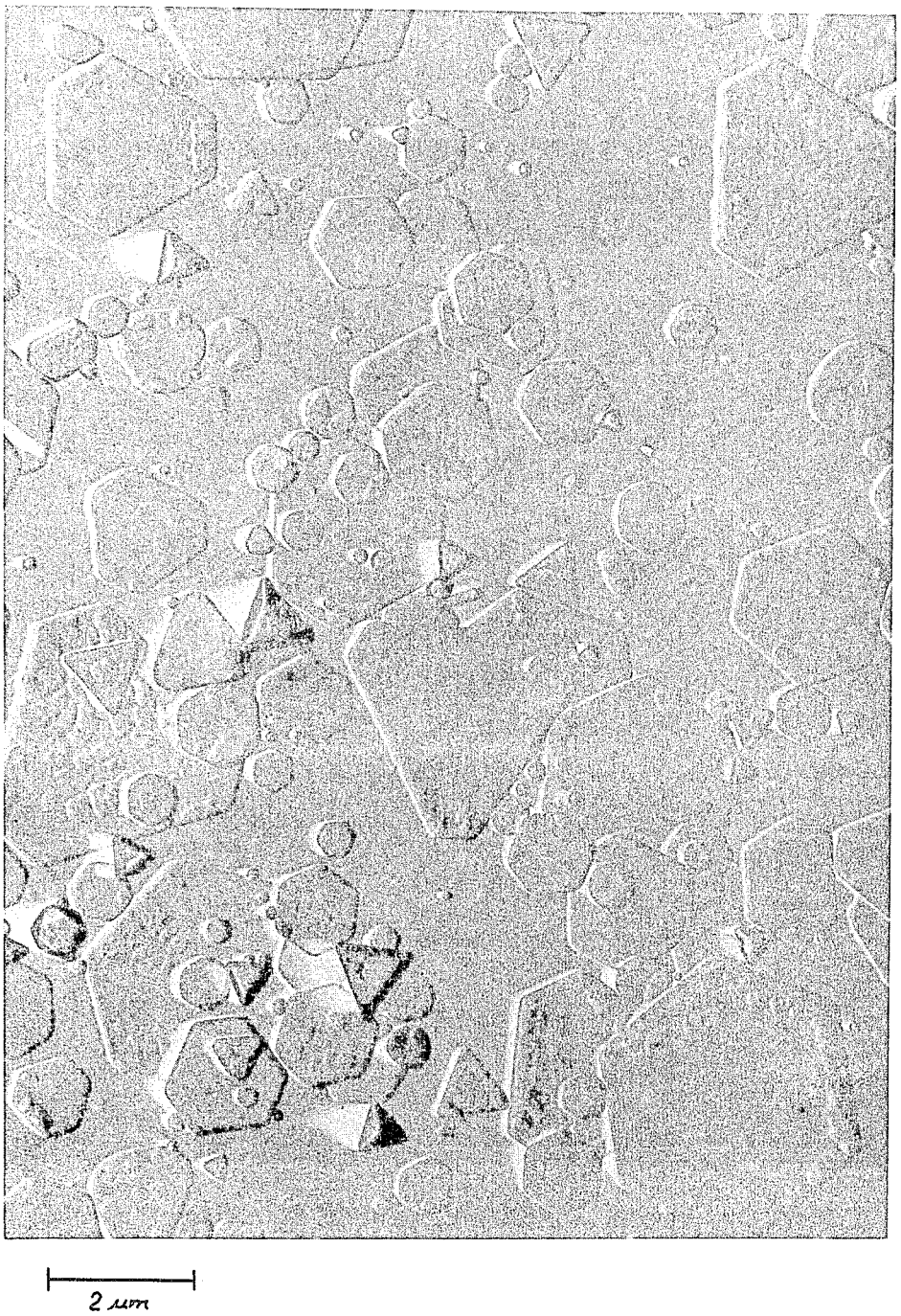

FIG. 13 represents a carbon replica electron micrograph of the emulsion. It shows that the silver chloride was deposited on the major crystal faces. Although some grains exhibit an observed preference for epitaxy near the edges of the major crystal faces, deposition is, in general, more or less random over the major crystal faces. Note that the AgBrI (6 mole % iodide) host emulsion was not spectrally sensitized prior to the addition of the silver chloride.

EXAMPLE 6

This example demonstrates the deposition of AgCl along the grain edges of a spectrally sensitized tabular grain AgBr emulsion.

EMULSION 6A

Tabular Grain AgBr Host

To 2.0 liters of a 1.5% gelatin solution containing 0.073M sodium bromide at 80° C. were added with stirring and by double-jet, a 0.30 molar NaBr solution and a 0.05 molar $AgNO_3$ solution over a five minute period, while maintaining the pBr of 1.14 (consuming 0.4% of the total silver used). The bromide and silver solutions were then run concurrently maintaining pBr 1.14 in an accelerated flow (3.0× from start to finish) over 4 minutes (consuming 0.66% of the silver used). Then a 1.5 molar NaBr solution and a 1.5 molar $AgNO_3$solution were added while maintaining pBr 1.14 in an accelerated flow (14.3× from start to finish) over 25 minutes (consuming 66.2% of the silver used). Then the acceleration was stopped and the solutions were added at a constant flow rate for 6.6 minutes (consuming 32.8% of the silver used). A total of approximately 3.03 moles of silver was used. The emulsion was cooled to 40° C., washed by the coagulation process of U.S. Pat. No. 2,614,929 of Yutzy and Russell, and stored at pAg 8.0 measured at 40° C. The resultant tabular grain AgBr emulsion had an average grain diameter of 5.0 μm, an average thickness of 0.09 μm, an aspect ratio of 56:1, and 85% of the grains were tabular based on total projected area.

EMULSION 6B

Major Crystal Face AgCl Epitaxial Growth

The AgBr host emulsion prepared above was centrifuged and resuspended in a $1.85\times10^{-2}$ molar NaCl solution. 2.5 mole % AgCl was precipitated into 40 grams of the emulsion (0.04 mole) by double-jet addition for 4.1 minutes of 0.55 molar NaCl and 0.50 molar $AgNO_3$ solutions while maintaining the pAg at 7.5 at 40° C. The emulsion was spectrally sensitized with 1.0 millimole Dye A', anhydro-5-chloro-9-ethyl-5'-phenyl-3,3'-bis(3-sulfopropyl)oxacarbocyanine hydroxide, triethylamine salt/Ag mole.

EMULSION 6C

Edge Selective AgCl Epitaxial Growth

This emulsion was prepared the same as in paragraph B above, except that spectral sensitization with 1.0 millimole Dye A'/Ag mole occured prior to the addition of the NaCl and $AgNO_3$ solutions.

Figure 14:
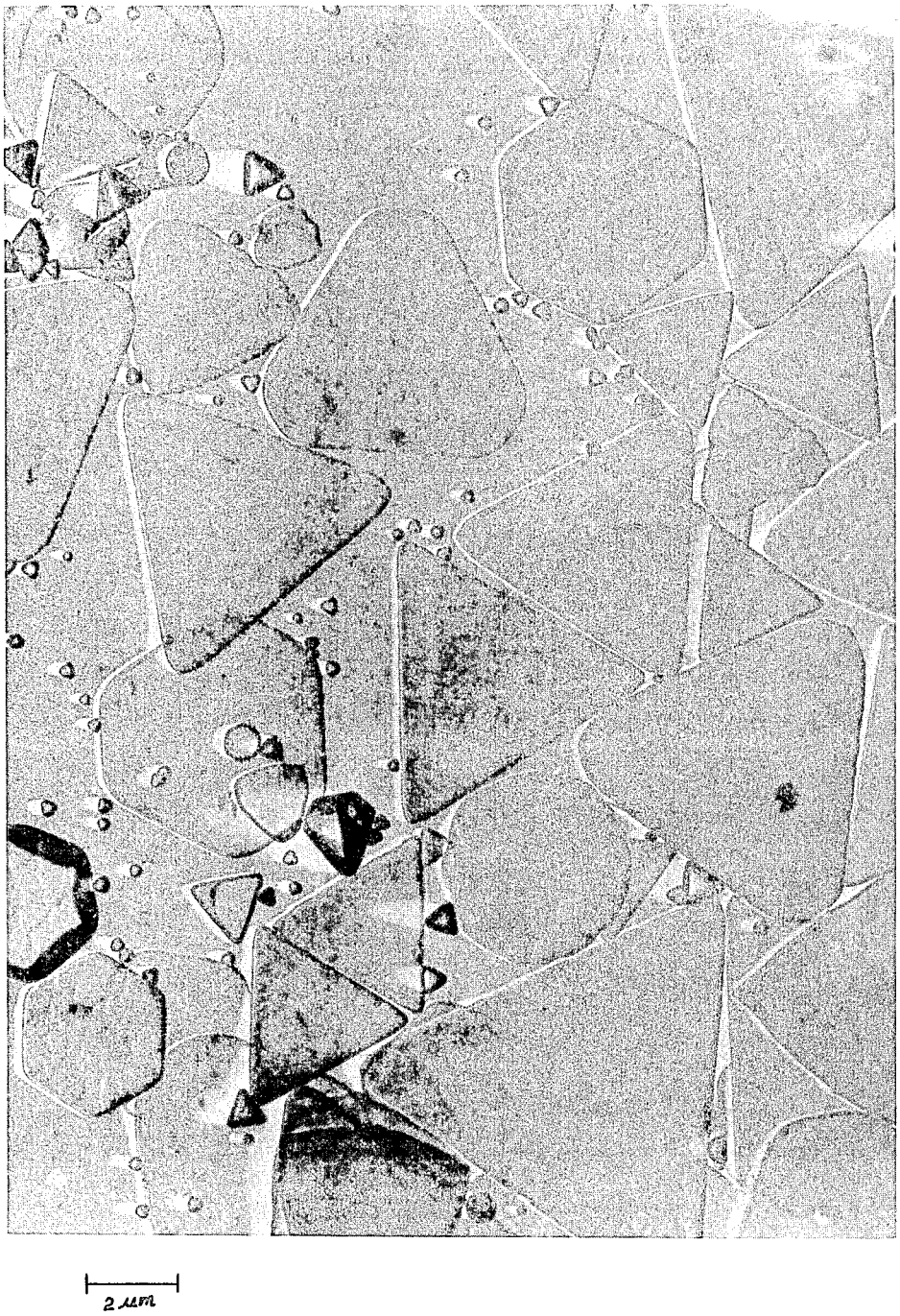
Figure 15:
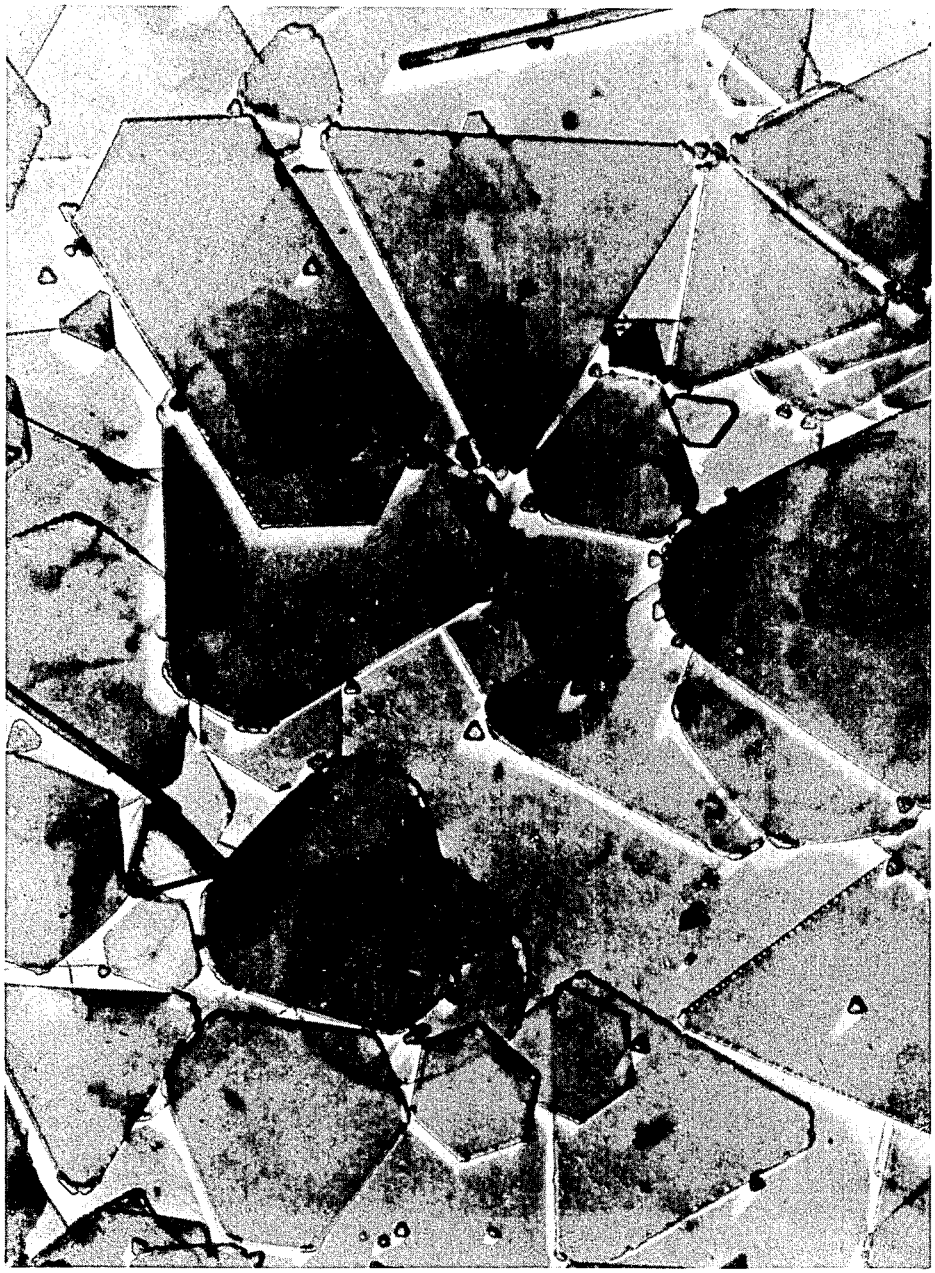

Emulsion 6B, which was spectrally sensitized following the addition of AgCl, had the AgCl deposited randomly over the crystal surface, see FIG. 14. Emulsion 6C, which was spectrally sensitized prior to the addition of AgCl, had AgCl deposited almost exclusively along the edges of the grain, see FIG. 15. In general the few small grains present that are shown overlying tabular grain major crystal faces are not epitaxially attached to the tabular grains, but are separate grains.

Emulsions 6B and 6C were coated on a polyester support at 1.61 g/m² silver and 3.58 g/m² gelatin. A 0.54 g/m² gelatin layer was coated over the emulsion layer. Emulsion coatings were exposed for 1/10 second to a 600W 2850° K. tungsten light source through a 0 to 6.0 density step tablet (0.30 steps) and processed from 1 to 20 minutes in a time of development series with a (Metol® N-methyl-p-aminophenol sulfate)-hydroquinone developer at 20° C. Sensitometric results are listed in Table II below.

TABLE II

| Emulsion | Epitaxy Pattern | Log Speed | $D_{min}$ |
|---|---|---|---|
| Control 6B | random | 235 | 0.10 |
| Example 6C | edge | 315 | 0.10 |

EXAMPLE 7

This example demonstrates that the addition of low levels of iodide to a tabular grain AgBr emulsion allows the epitaxial deposition of AgCl at the corners of non-spectrally sensitized host tabular crystals. The iodide ions act as an adsorbed site director for subsequent epitaxy.

CONTROL EMULSION 7A

Random Major Crystal Face AgCl Epitaxial Growth

The tabular grain AgBr host Emulsion 6A described in paragraph A, Example 6, was centrifuged and resuspended in a $1.85\times10^{2}$ molar NaCl solution. Then 2.5 mole % AgCl was precipitated into 40 g of the host emulsion (0.04 mole) by double-jet addition for 4.1 minutes of 0.55 molar NaCl and 0.5 molar $AgNO_3$ solutions while maintaining the pAg at 7.5 at 40° C. The emulsion was then spectrally sensitized with 1.0 millimole Dye A'/Ag mole.

EMULSION 7B

Corner Selective AgCl Epitaxial Growth

To 400 g of the AgBr host Emulsion 6A (0.4 mole) was added 0.5 mole percent iodide by the introduction of a $4.0\times10^{-2}$ molar KI solution over 10 minutes at 5.0 ml/minute. The emulsion was centrifuged and resuspended in a $1.85\times10^{-2}$ molar NaCl solution. Then 2.5 mole % AgCl was precipitated into 40 g of the host emulsion (0.04 mole) by double-jet addition for 4 minutes of 0.55 molar NaCl and 0.50 molar $AgNO_3$ solutions while maintaining the pAg at 7.5 at 40° C. The emulsion was then spectrally sensitized with 1.0 millimole Dye A'/Ag mole.

CONTROL EMULSION 7C

AgCl Free I Ion Added Control

Emulsion 7C was prepared and spectrally sensitized the same as Emulsion 7B above, except the epitaxial deposition of AgCl was omitted.

Figure 16:
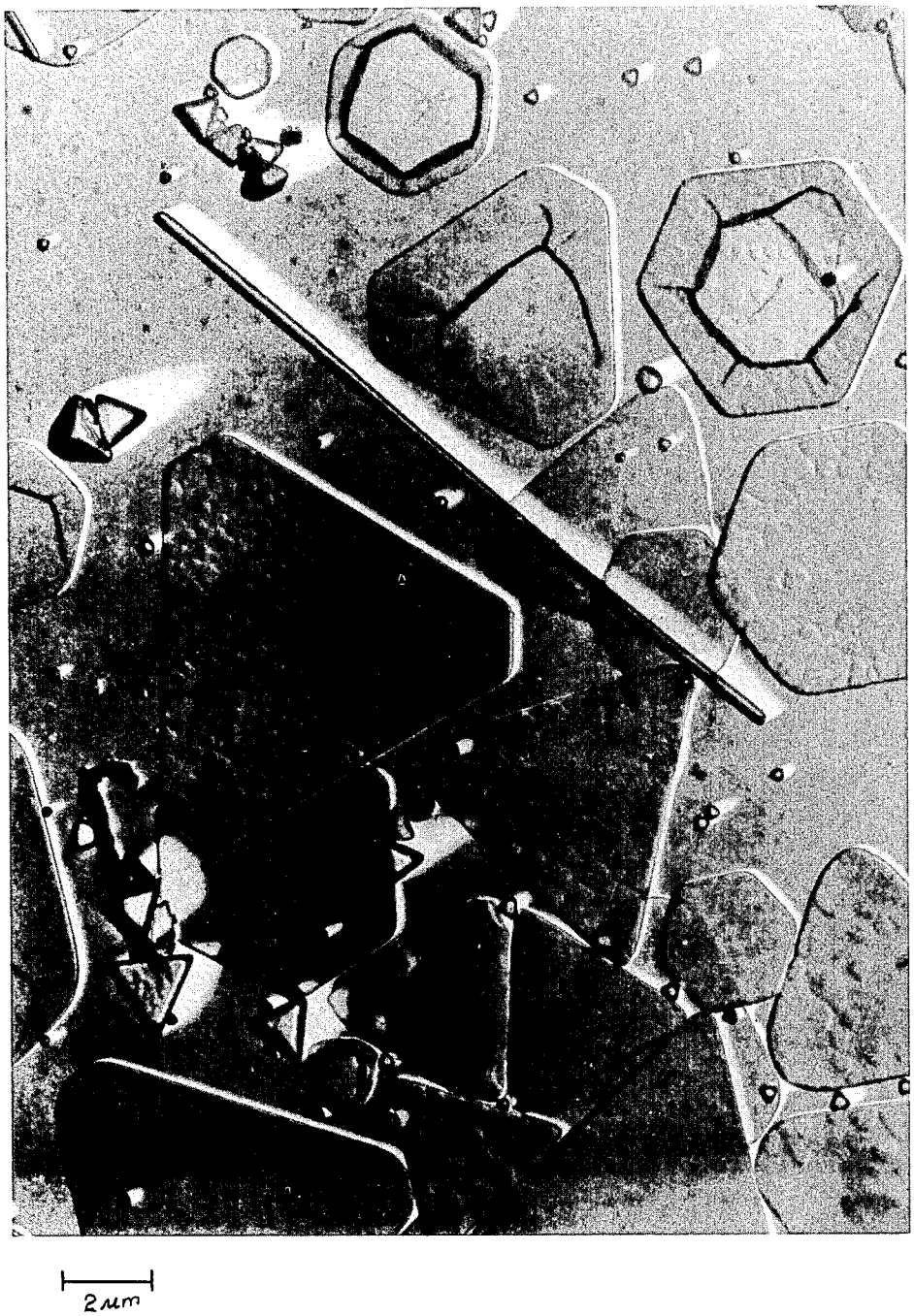
Figure 17:
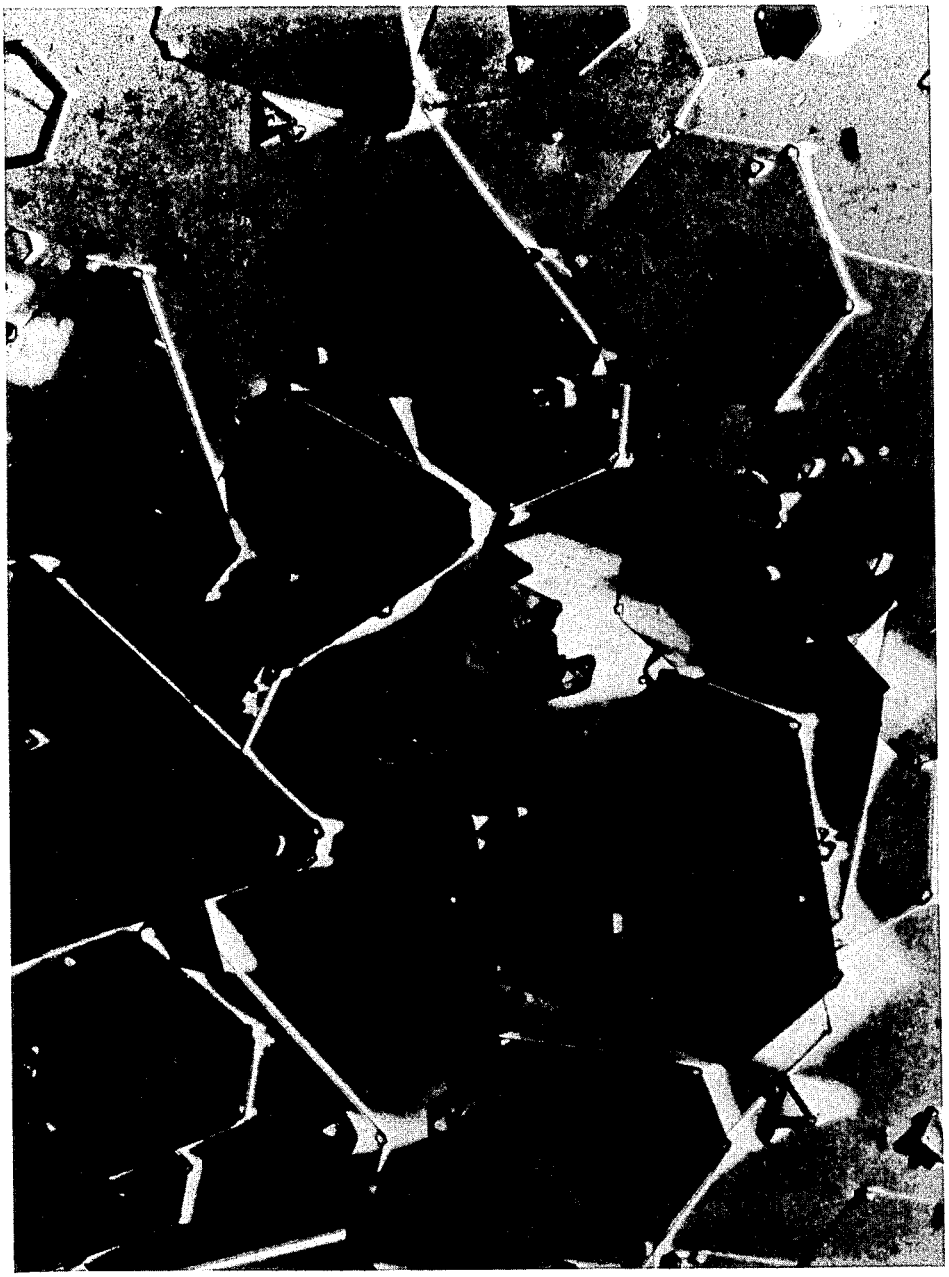

Emulsion 7A, which was spectrally sensitized following the addition of AgCl, had the AgCl deposited randomly over the entire major crystal faces; see FIG. 16. Emulsion 7B, to which 0.5 mole percent KI was added prior to the addition of AgCl, had the AgCl deposited almost exclusively at the corners of the grain; see FIG. 17. The small grains overlying major crystal faces were separate and not epitaxially grown on the major crystal faces.

Emulsions 7A, 7B and 7C were coated, exposed, and processed in a time of development series as described in Example 6. Sensitometric results are listed in Table III below.

TABLE III

| Emulsion | Epitaxy | Log Speed | $D_{min}$ |
|---|---|---|---|
| 7A AgCl/AgBr | Random | 240 | 0.15 |
| 7B AgCl/(AgBr + $I^-$) | Corner | 326 | 0.15 |
| 7C AgBr + $I^-$ | None | 245 | 0.15 |

EXAMPLE 8

This example illustrates the epitaxial deposition of AgCl almost exclusively at the corners of a spectrally sensitized tabular grain AgBr emulsion.

EMULSION 8A

Tabular Grain AgBr Host

To 3.0 liters of a 1.5% gelatin solution containing 0.067M sodium bromide at 80° C. were added with stirring and by double-jet, a 0.1 molar NaBr solution and a 0.1 molar $AgNO_3$ solution over 3.75 minutes while maintaining the pBr 1.17 (consuming 0.22% of the total silver used). Then a 3.0 molar NaBr solution and a 3.0 molar $AgNO_3$ solution were run concurrently maintaining pBr 1.17 in an accelerated flow (24.8× from start to finish) over 31 minutes (consuming 91.0% of the total silver used). The NaBr solution was stopped and the $AgNO_3$ solution was continued until pAg of 7.75 was reached (consuming 6.8% of the total silver used). A total of approximately 6.85 moles of silver was used. The emulsion was cooled to 40° C., washed by the coagulation method of U.S. Pat. No. 2,614,929 of Yutzy and Russell, and stored at pAg 8.5 measured at 40° C. The resultant tabular grain AgBr emulsion had an average grain size of 2.9 μm, an average thickness of 0.11 μm, an average aspect ratio of 26:1, and 96% of the grains were tabular based on projected area.

EMULSION 8B

Corner Selective AgCl Epitaxial Growth 40.0 g of the tabular grain AgBr host Emulsion 8A (0.04 mole) prepared above was adjusted to pAg 7.2 at 40° C. with a 0.1 molar $AgNO_3$ solution. The emulsion was spectrally sensitized with 1.6 millimole Dye C/Ag mole and stirred for 5 minutes at 40° C. Then 1.0 ml of a 0.5 molar NaCl solution was added. Then 5.0 mole % AgCl was precipitated into the host grain emulsion by double-jet addition for 8 minutes of 0.52 molar NaCl and 0.5 molar $AgNO_3$ solutions while maintaining the pAg at 7.2 at 40° C.

Figure 18:
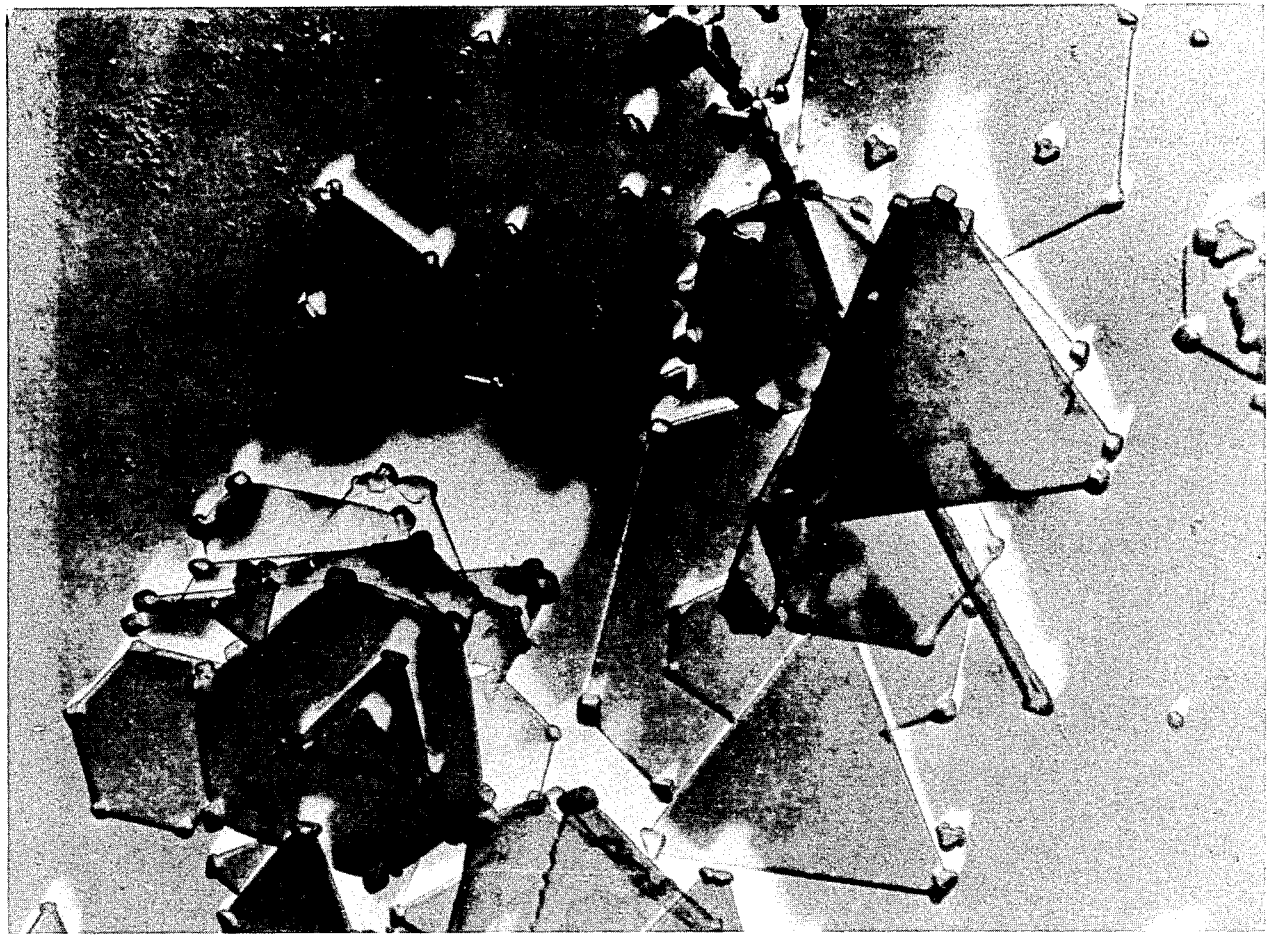

FIG. 18 represents a carbon replica electron micrograph of the AgCl/AgBr epitaxial emulsion.

EXAMPLE 9

This example illustrates the selective corner epitaxial growth of AgCl on a tabular grain AgBrI emulsion.

EMULSION 9A

Tabular Grain AgBrI (6 mole % iodide) Host

To 6.0 liters of a 1.5% gelatin solution at 55° C. containing 0.12M potassium bromide were added with stirring and by double-jet, a 1.12 molar KBr solution which contained 0.06 molar KI and a 1.0 molar $AgNO_3$ solution over a period of 8 minutes (consuming 5.0% of the total silver used). At the same time the temperature was increased over 7 minutes to 70° C. Then a 2.0 molar KBr solution which contained 0.12 molar KI and a 2.0 molar $AgNO_3$ solution were run concurrently maintaining pBr of 0.92 at 70° C. in an accelerated flow (4.0× from start to finish) over 30 minutes (consuming 95.0% of the total silver used). A total of approximately 3.16 moles of silver was used. The emulsion was cooled to 35° C., washed by the coagulation method of Yutzy and Russell U.S. Pat. No. 2,614,929 and stored at pAg 8.2 measured at 35° C. The resultant tabular grain AgBrI (6 mole % iodide) emulsion had an average grain size of 2.7 μm, an average grain thickness of 0.08 μm, an average aspect ratio of 34:1, and 85% of the grains were tabular based on total projected area.

EMULSION 9B

Corner Selective AgCl Epitaxial Growth 40 g of the tabular grain AgBrI host Emulsion 9A (0.04 mole) prepared above was adjusted to pAg 7.2 at 40° C. with a 0.1 molar $AgNO_3$ solution. 1.0 ml of a 0.54 molar NaCl solution was added. The emulsion was spectrally sensitized with 1.0 millimole of Dye A'/Ag mole. Then 5.0 mole % AgCl was precipitated into the host tabular grain emulsion by double-jet addition for 7.8 minutes of 0.54 molar NaCl and 0.50 molar $AgNO_3$ solutions while maintaining the pAg at 7.5 at 40° C.

Figure 19A:
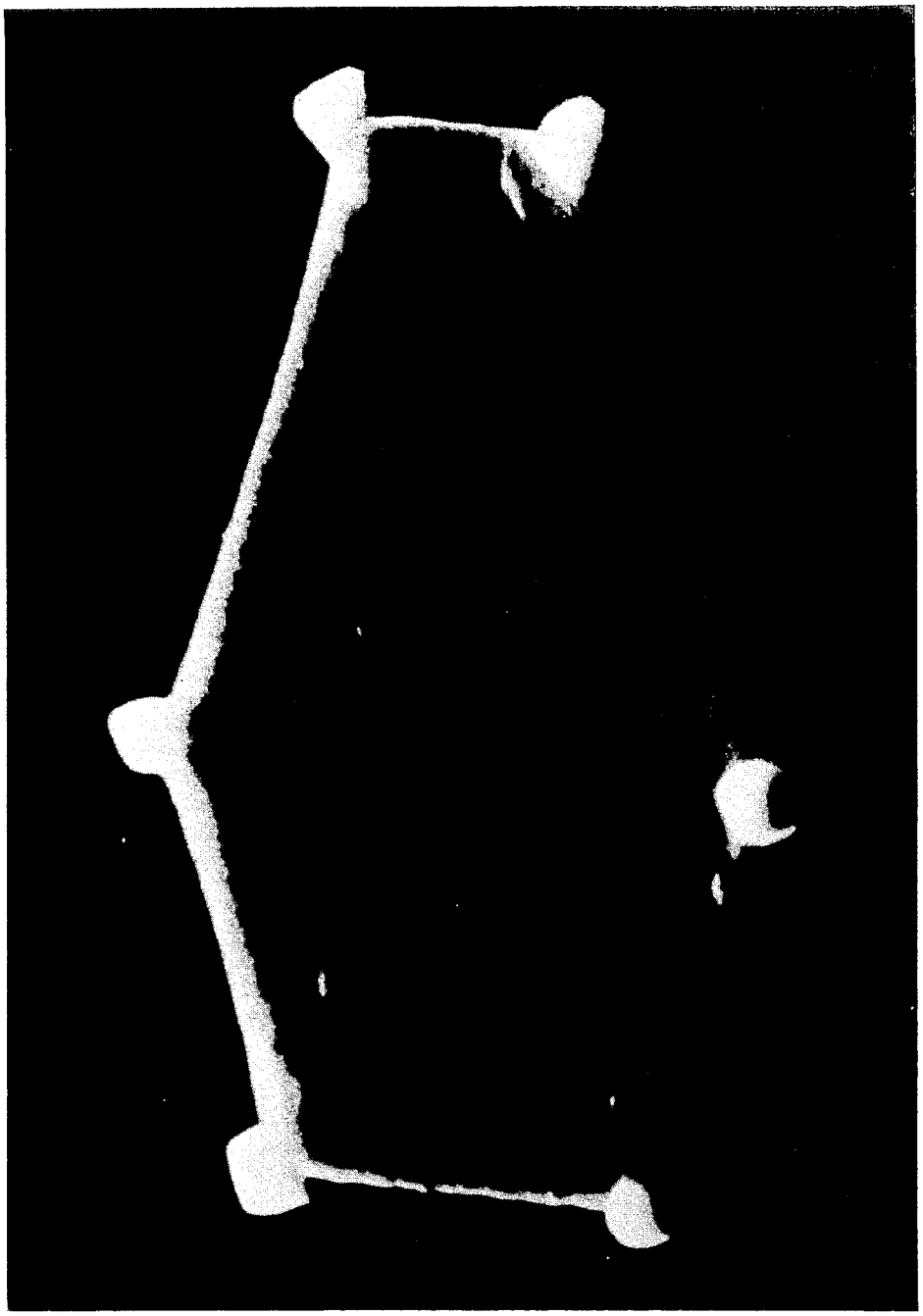
Figure 19B:
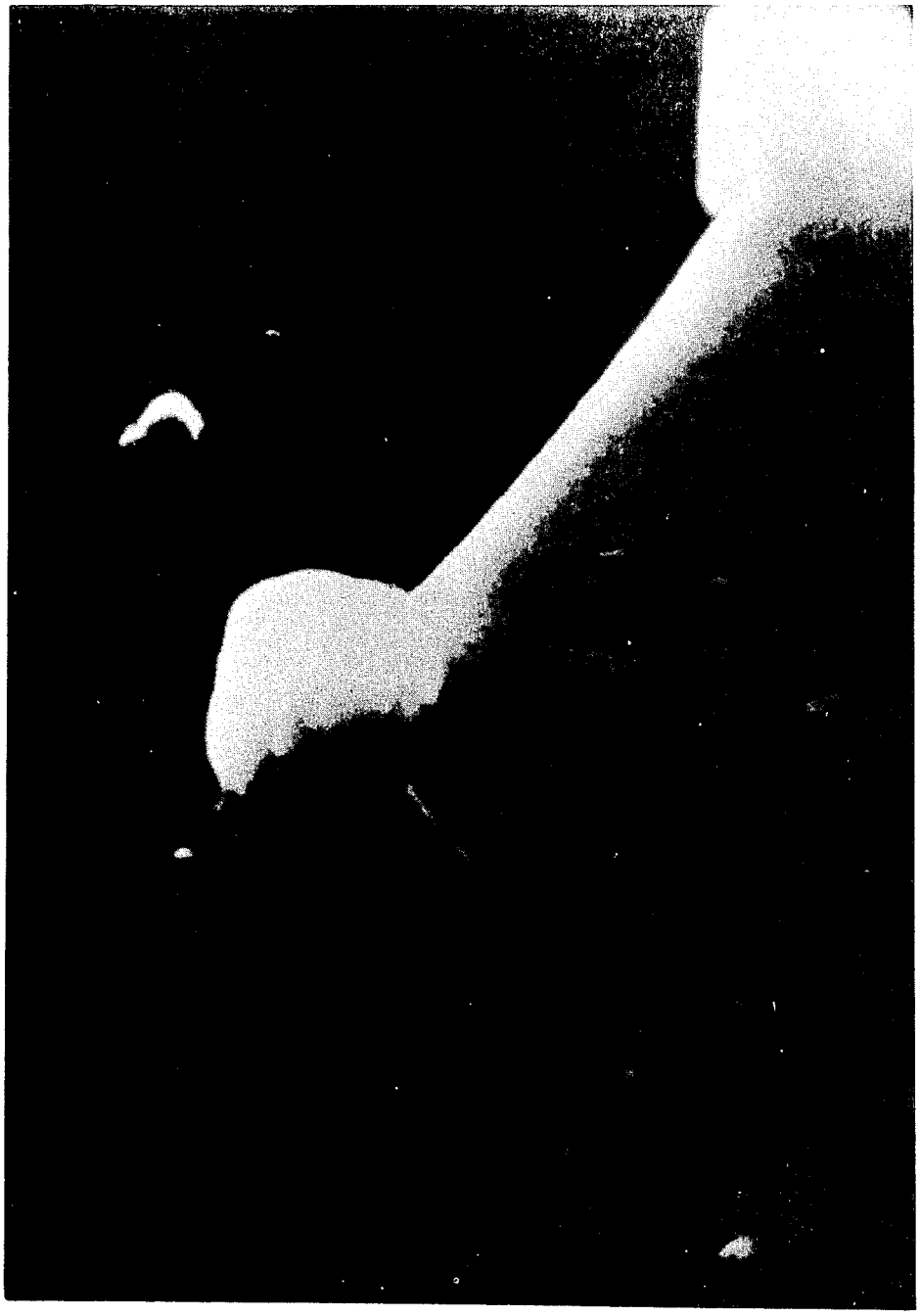

FIG. 19A and FIG. 19B represent secondary electron micrographs of the Emulsion 9B illustrating the epitaxial deposition of 5.0 mole % AgCl at the corners of the AgBrI (6 mole % iodide) tabular crystal.

EXAMPLE 10

This example illustrates sensitivity and minimum density, both fresh and upon keeping, as a function of epitaxy. This example further illustrates the location of latent image formation by examination of partially developed grains.

EMULSION 10A

Chemically and Spectrally Sensitized Tabular Grain AgBrI (6 Mole % Iodide) Host Emulsion 5A The tabular grain AgBrI (6 mole % iodide) host Emulsion 5A was chemically sensitized with 5 mg $Na_2S_2O_3 \cdot 5H_2O$/Ag mole plus 5 mg $KAuCl_4$/Ag mole for 10 minutes at 60° C. and then spectrally sensitized with 1.5 millimole Dye A'/Ag mole. The emulsion was coated on a polyester support at 1.61 g/m$^2$ silver and 3.58 g/m$^2$ gelatin. The emulsion layer was overcoated with a 0.54 g/m$^2$ gelatin layer.

EMULSION 10B

Spectrally Sensitized AgCl/AgBrI Epitaxial Emulsion

The tabular grain AgBrI (6 mole % iodide) host Emulsion 5A (0.04 mole) was adjusted to pAg 7.2 at 40° C. by the simultaneous addition of 0.1 molar $AgNO_3$ and 0.006 molar KI. Then 1.0 ml of a 0.80 molar NaCl solution was added. The emulsion was spectrally sensitized with 1.5 millimole Dye A'/Ag mole. Then 1.25 mole % AgCl was precipitated into the host tabular grain emulsion by double-jet addition for two minutes of 0.54 molar NaCl and 0.50 molar $AgNO_3$ solutions while maintaining the pAg at 7.5 at 40° C.

EMULSION 10C

Chemically and Spectrally Sensitized AgCl/AgBrI Epitaxial Emulsion

Figure 20:
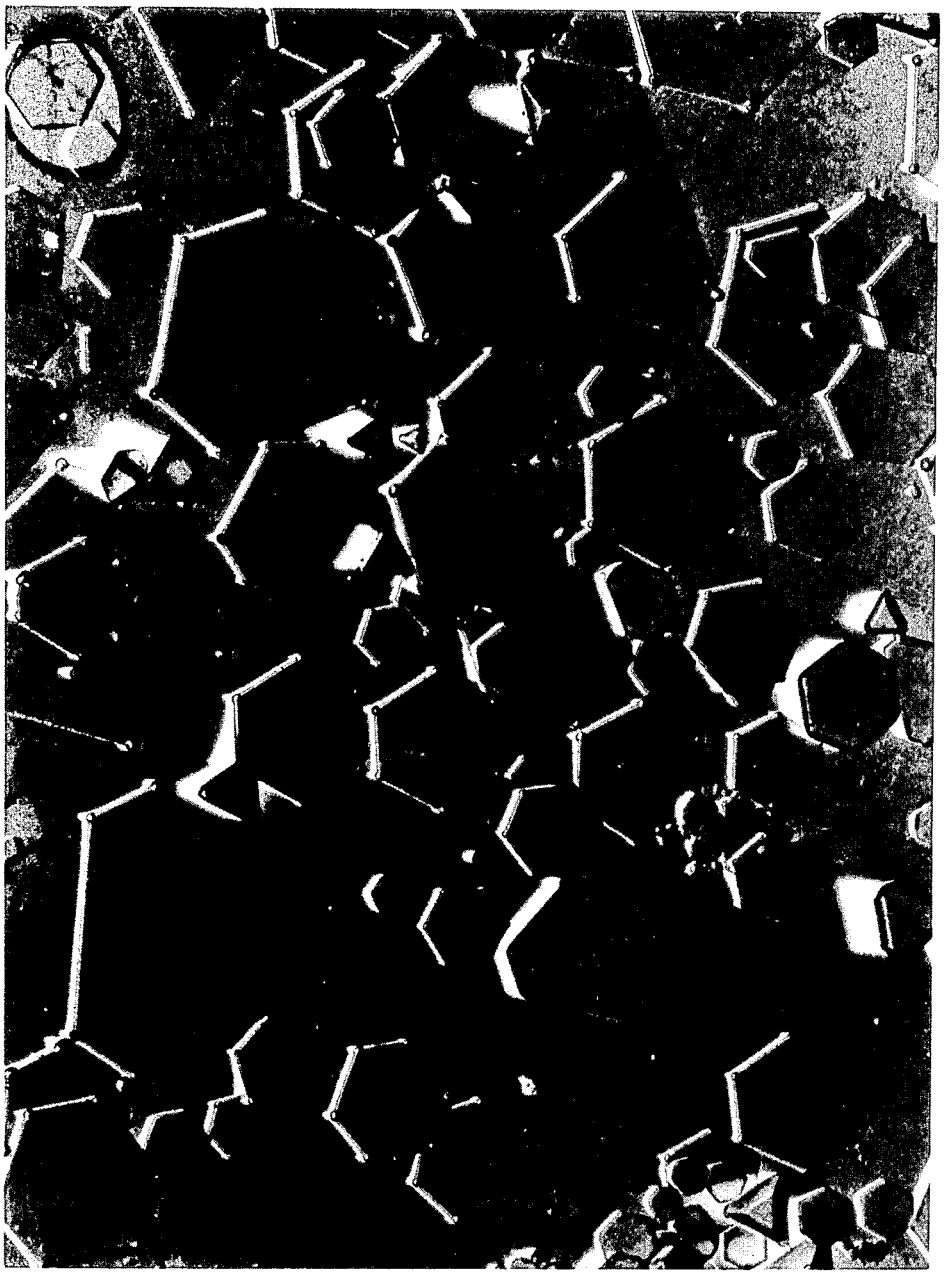

The tabular grain AgBrI (6 mole % iodide) host emulsion 1A was adjusted to pAg 7.2 at 40° C. by the simultaneous addition of 0.1 molar $AgNO_3$ and 0.006 molar KI. Then 1.0 ml of a 0.74 molar NaCl solution was added. The emulsion was spectrally sensitized with 1.5 millimole Dye A'/Ag mole and held for 30 minutes at 40° C. The emulsion was centrifuged and resuspended in a $1.85 \times 10^{-2}$ molar NaCl solution two times. Then 1.25 mole % AgCl was precipitated into 40 g of the host tabular grain emulsion (0.04 mole) by double-jet addition for 2.1 minutes of 0.54 molar NaCl and 0.50 molar $AgNO_3$ solutions while maintaining the pAg at 7.5 at 40° C. The emulsion was also chemically sensitized with 0.5 mg $Na_2S_2O_3 \cdot 5H_2O$/Ag mole and 0.5 mg $KAuCl_4$/Ag mole added 15 seconds after the NaCl and $AgNO_3$ reagents were started. FIG. 20 is an electron micrograph of this emulsion, showing corner selective epitaxy.

EMULSION 10D

Chemically and Spectrally Sensitized AgCl/AgBrI Epitaxial Emulsion

Emulsion 10D was prepared similarly as Emulsion 10C above, except that during epitaxial deposition of AgCl on the spectrally sensitized host AgBrI crystal, the emulsion was chemically sensitized with 1.0 mg $KAuCl_4$/Ag mole and 1.0 mg $Na_2S_2O_3.5H_2O$/Ag mole.

The emulsions above were coated, exposed, and processed in a time of development series as described in Example 6. Sensitometric results are reported in Table IV below.

TABLE IV

| Emulsion | Log Speed* | $D_{min}$ |
|---|---|---|
| 10A | 193 | 0.10 |
| 10B | 311 | 0.10 |
| 10C | 343 | 0.10 |
| 10D | 346 | 0.10 |

*30 = 0.3 log E, where E is exposure in meter-candle-seconds

As revealed in Table IV, the spectrally sensitized epitaxial AgCl/AgBrI tabular grain Emulsions 10B, 10C, and 10D with and without chemical sensitization were significantly faster in speed (≃1.2 log E) than the chemically and spectrally sensitized host AgBrI Emulsion 10A. Also, significantly less chemical sensitizer was used for Emulsions 10C and 10D than for Emulsion 10A.

Coatings of Emulsions 10A and 10C were also held for 1 week at 49° C. and 50% relative humidity and then exposed for 1/10 second to a 600 W 2850° K. tungsten light source through a 0 to 6.0 density step tablet (0.30 steps) and processed for 6 minutes with a Metol® (N-methyl-p-aminophenol sulfate)-hydroquinone developer at 20° C. Sensitometric results reveal that the epitaxial AgCl/AgBrI Emulsion 10C was faster in speed and displayed less fog than host AgBrI Emulsion 10A. See Table V.

TABLE V

| | 1 week at 49° C., 50% Relative Humidity | |
|---|---|---|
| Emulsion | Log Speed | $D_{min}$ |
| 10A | 225 | 0.22 |
| 10C | 336 | 0.09 |

EXAMPLE 11

This example demonstrates the photographic response of a tabular grain AgCl/AgBrI epitaxial emulsion with spectral sensitization prior to AgCl deposition vs. spectral sensitization after AgCl deposition.

EMULSION 11A

Corner Selective AgCl Epitaxial Growth (spectrally sensitized prior to precipitation of silver chloride)

The tabular grain AgBrI (6 mole % iodide) host Emulsion 5A was adjusted to pAg 7.2 at 40° C. by the simultaneous addition of 0.10 molar $AgNO_3$ and 0.006 molar KI solutions. 1.0 ml of a 0.74 molar NaCl solution was added. The emulsion was spectrally sensitized with 1.5 millimole Dye A'/Ag mole and held for 30 minutes at 40° C. The emulsion was then centrifuged and resuspended in $1.85\times10^{-2}$ molar NaCl solution two times. Then 1.25 mole % AgCl was precipitated into the host tabular grain emulsion by double-jet addition for two minutes of 0.54 molar NaCl and 0.50 molar $AgNO_3$ solutions while maintaining the pAg at 7.5 at 40° C. At 15 seconds after the start of the NaCl and $AgNO_3$ reagents 0.5 mg $Na_2S_2O_3.5H_2O$/Ag mole and 0.5 mg $KAuCl_4$/Ag mole were added.

EMULSION 11B

Random Major Face AgCl Epitaxial Growth (spectrally sensitized after the precipitation of silver chloride)

Emulsion 11B was prepared the same as Emulsion 11A above, except that the spectral sensitization with 1.5 millimole Dye A'/Ag mole occurred following the AgCl deposition.

Electron micrographs of Emulsion 11A, which was spectrally sensitized prior to the addition of AgCl, revealed the AgCl deposited exclusively near the corners of the AgBrI tabular crystal. However, Emulsion 11B, which was spectrally sensitized following the precipitation of AgCl, showed the AgCl deposited randomly over the major crystal faces.

Emulsions 11A and 11B were coated on cellulose triacetate support at 1.61 g/m² silver and 3.58 g/m² gelatin and exposed and processed in a time of development series similar to that described in Example 6. Sensitometric results reveal that at equal Dmin (0.10) Emulsion 11A was 0.70 log E faster in speed than Emulsion 11B.

EXAMPLE 12

This example demonstrates the photographic response of an AgCl/AgBrI epitaxial emulsion spectrally sensitized prior to the addition of the silver chloride.

EMULSION 12A

Corner Selection AgCl Epitaxial Growth 40 g of the tabular grain AgBrI (6 mole % iodide) host Emulsion 5A (0.04 mole) was adjusted to pAg 7.2 at 40° C. by the simultaneous addition of 0.1 molar $AgNO_3$ and 0.006 molar KI. Then 1.0 ml of a 0.8 molar NaCl solution was added. The emulsion was spectrally sensitized with 1.87 millimole Dye D, anhydro-9-ethyl-5,5'-diphenyl-3,3'-bis(3-sulfobutyl)-oxacarbocyanine hydroxide, triethylamine salt/Ag mole and held for 30 minutes at 40° C. Then 1.25 mole % AgCl was precipitated into the host tabular grain emulsion by double-jet addition for 2 minutes of 0.54 molar NaCl and 0.50 molar $AgNO_3$ solutions while maintaining the pAg at 7.5 at 40° C.

EMULSION 12B

Au Sensitized Corner Selective AgCl Epitaxial Growth

Emulsion 12B was prepared the same as Emulsion 12A above, except that 15 seconds after the start of the NaCl and $AgNO_3$ reagents 1.0 mg $KAuCl_4$/Ag mole was added.

EMULSION 12C

Sulfur Sensitized Corner Selective AgCl Epitaxial Growth Emulsion 12C was prepared the same as Emulsion 12A above, except that 15 seconds after the start of the NaCl and $AgNO_3$ reagents 1.0 mg $Na_2S_2O_3.5H_2O$/Ag mole was added. Also after the precipitation was complete, the emulsion was heated for 10 minutes at 60° C.

EMULSION 12D

Se Sensitized Corner Selective AgCl Epitaxial Growth

EMULSION 12D was prepared the same as Emulsion 12A above, except that 15 seconds after the start of the NaCl and $AgNO_3$ reagents 0.17 mg sodium selenite ($Na_2SeO_3$)/Ag mole was added.

Figure 21:
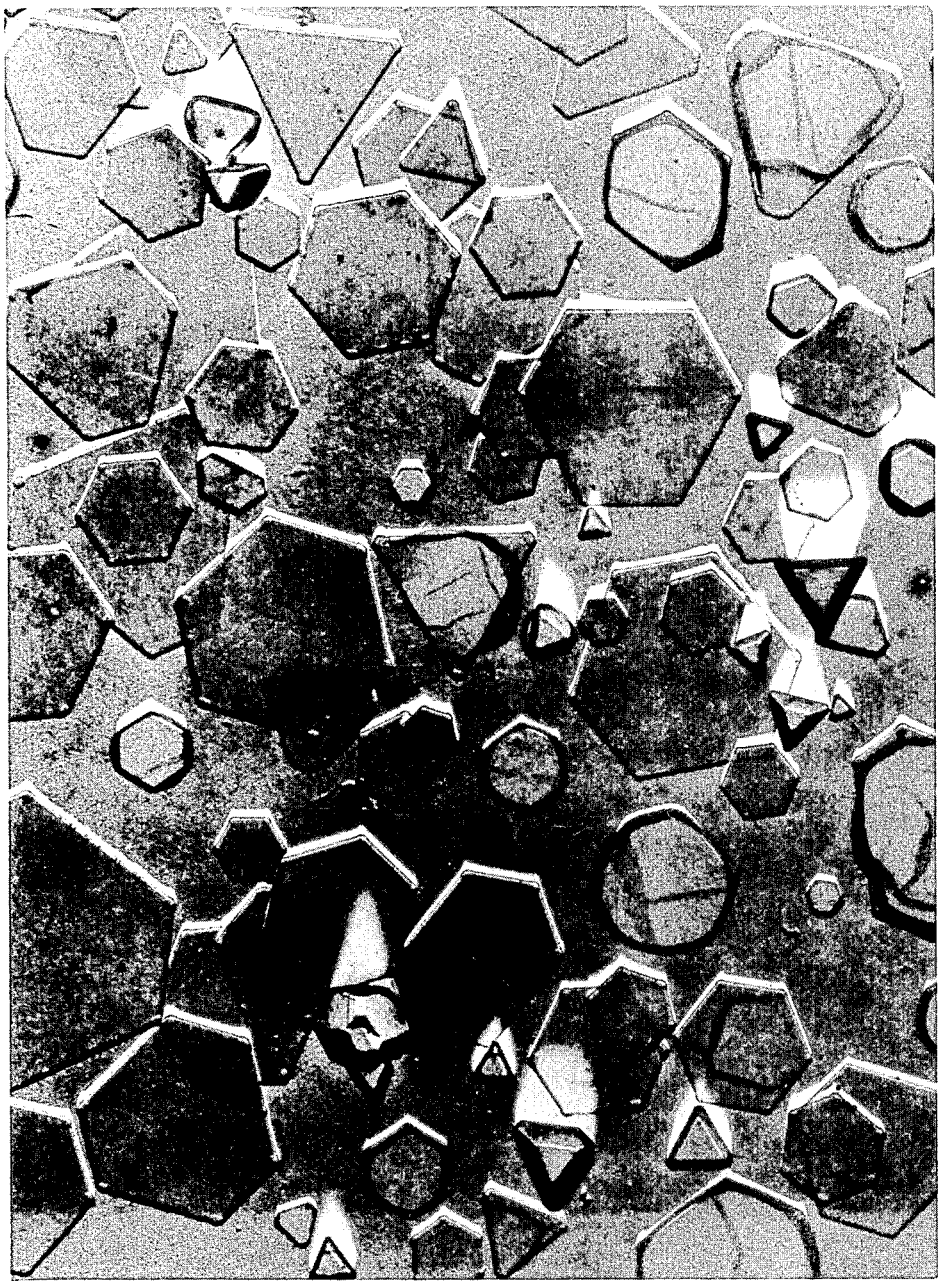

Emulsions 12A through 12D were coated on cellulose triacetate film support at 1.15 g/m$^2$ silver and 3.5 g/m$^2$ gelatin. In addition, the tabular grain AgBrI host Emulsion 5A was spectrally sensitized with 1.87 mg Dye D/Ag mole and coated as above. Also, the tabular grain AgBrI host emulsion was first chemically sensitized with 5 mg $KAuCl_4$/Ag mole plus 5 mg $Na_2S_2O_3.5H_2O$/Ag mole for 10 minutes at 60° C. and then spectrally sensitized with 1.87 mg Dye D/Ag mole and coated as described. The coatings were exposed for 1/10 second to a 600 W 5500° K. tungsten light source through a 0–4.0 density continuous wedge tablet and processed for 6 minutes in a Metol® (N-methyl-p-aminophenol sulfate)-hydroquinone developer at 20° C. Sensitometric results reveal that the AgCl/AgBrI epitaxial emulsions 12A through 12D are significantly faster in speed (>2.0 log E) with higher $D_{max}$ than the spectrally sensitized tabular grain AgBrI host emulsion with and without chemical sensitization. See Table VI below.

were added. See FIG. 21 for a carbon replica electron micrograph of the AgBr/AgBrI epitaxial emulsion.

The tabular grain AgBrI host Emulsion 5A was chemically sensitized with 5.0 mg $KAuCl_4$/Ag mole and 5.0 mg $Na_2S_2O_3.5H_2O$/Ag mole for 13 minutes at 60° C., and then spectrally sensitized with 1.5 millimole Dye A'/Ag mole. The host Emulsion 5A and the AgBr/AgBrI epitaxial emulsion were coated, exposed and processed as described in Example 6. Sensitometric results reveal that the epitaxial Emulsion 13A, which was sensitized with significantly less chemical sensitizer and at a lower temperature, was approximately 0.80 log E faster in speed at equal $D_{min}$ (0.10) than the sensitized AgBrI host Emulsion 5A.

EXAMPLE 14

This example demonstrates the epitaxial deposition of AgCl on a tabular grain AgBr emulsion that was spectrally sensitized with a supersensitizing dye combination.

EMULSION 14A

Tabular Grain AgBr Host

This emulsion was prepared similarly as tabular grain AgBr host Emulsion 6A of Example 6. The average grain diameter was 3.9 μm, and average grain thickness was 0.09 μm. The grains having a thickness of less than 0.3 micron and a diameter of at least 0.6 micron exhibited an average aspect ratio of 43:1 and accounted for 90% of the total projected area of the silver bromide grains.

EMULSION 14B

AgCl/AgBr Selective Corner Growth Emulsion Spectrally Sensitized with Dye Combination

TABLE VI

| Emulsion | Sensitization: Spectral (mM Dye C/mole) | Sensitization: Chemical (mg/mole) | Log Speed | Contrast | $D_{min}$ | $D_{max}$ |
|---|---|---|---|---|---|---|
| 5A Host AgBrI | (1.87) | — | — | 0.05 | 0.12 | 0.32 |
| 5A Host AgBrI | (1.87) | $KAuCl_4CL_4$ (5) + $NA_2S_2O_3.5_2O$ (5) | 64 | 0.68 | 0.10 | 0.77 |
| 12A AgCl/AgBrI | (1.87) | — | 270 | 0.67 | 0.10 | 0.88 |
| 12B AgCl/AgBrI | (1.87) | $KAuCl_4$ (1) | 283 | 0.68 | 0.11 | 0.97 |
| 12C AgCl/AgBrI | (1.87) | $Na_2S_2O_3.5H_2O$ (1) | 298 | 0.71 | 0.12 | 1.03 |
| 12D AgCl/AgBrI | (1.87) | $Na_2SeO_3$ (.17) | 283 | 0.82 | 0.10 | 0.99 |

EXAMPLE 13

This example demonstrates the epitaxial deposition of AgBr at the corners of the spectrally sensitized AgBrI tabular crystals.

EMULSION 13A

Corner Selective AgBr Epitaxial Growth

Tabular grain AgBrI (6 mole % iodide) host Emulsion 5A was spectrally sensitized with 1.5 millimole Dye A'/Ag mole. Following spectral sensitization the emulsion was centrifuged and resuspended in distilled water two times. Then 0.6 mole % AgBr was precipitated into 40 g of the spectrally sensitized AgBrI host emulsion (0.04 mole) by double-jet addition for 1.5 minutes of 0.2 molar NaBr and 0.2 molar $AgNO_3$ solutions while maintaining the pAg at 7.5 at 40° C. At 15 seconds after the start of the NaBr and $AgNO_3$ reagents 1.0 mg $Na_2S_2O_3.5H_2O$/Ag mole and 1.0 mg $KAuCl_4$/Ag mole 40 g of the tabular grain AgBr host Emulsion 14A (0.04 mole) was adjusted to pAg 7.2 at 40° C. with a 0.1 molar $AgNO_3$solution. Then 1.0 ml of a 0.61 molar NaCl solution was added. The emulsion was spectrally sensitized with 1.5 millimole Dye C/Ag mole.

1.25 mole % AgCl was precipitated within the host tabular grain emulsion by double-jet addition for 2 minutes of 0.54 molar NaCl and 0.50 molar $AgNO_3$ solutions while maintaining the pAg at 7.5 at 40° C.

SENSITOMETRIC RESULTS

Coating 1:

The tabular grain AgBr host Emulsion 14A was spectrally sensitized with 1.5 millimoles Dye C/Ag mole and 0.15 millimole Dye E 2-(p-diethylaminostyryl)benzothiazole/Ag mole and then coated on a polyester support at 1.73 g/m$^2$ silver and 3.58 g/m$^2$ gelatin. The emulsion layer was overcoated with 0.54 g/m$^2$ gelatin.

Coating 2:

The tabular grain AgBr host Emulsion 14A was chemically sensitized with 1.5 mg $KAuCl_4$/Ag mole plus 1.5 mg $Na_2S_2O_3.5H_2O$/Ag mole for 10 minutes at 65° C. The emulsion was then spectrally sensitized and coated as described for Coating 1.

Coating 3:

The tabular grain AgCl/AgBr epitaxial Emulsion 14B spectrally sensitized with Dye C was additionally sensitized with 0.15 millimole of Dye E per silver mole following the silver chloride deposition and then was coated as described for Coating 1.

The coatings were exposed and processed in a time of development series as described in Example 6. Sensitometric results are given in Table VII below.

TABLE VII

| Coating | Emulsion | Spectral Sensitization (millimole/Ag mole) | Chemical Sensitization (mg/Ag mole) | Log Speed | $D_{min}$ |
|---|---|---|---|---|---|
| 1 | Host AgBr | Dye B (1.5) + D (0.15) | — | 255 | 0.20 |
| 2 | Host AgBr | Dye B (1.5) + D (0.15) | $KAuCl_4$ (1.5) + $Na_2S_2O_3 \cdot .5H_2O$ (1.5) | 323 | 0.20 |
| 3 | AgCl/AgBr | Dye B (1.5) + D (0.15) | — | 386 | 0.20 |

As illustrated above, the epitaxial AgCl/AgBr Emulsion 14B, which was spectrally sensitized prior to the deposition of AgCl, was 131 log speed units faster than the spectrally sensitized host Emulsion 14A. Also, Emulsion 14B was even 63 log speed units faster than the chemically and then spectrally sensitized host Emulsion 14A.

EXAMPLE 15

This example illustrates a AgCl/AgBrI epitaxial emulsion prepared by the addition of a fine grain AgCl emulsion to a tabular grain AgBrI emulsion.

EMULSION 15A

AgCl Fine Grain Emulsion

To 3.0 liters of a 3.3% gelatin solution containing $3.4\times10^{-3}$ molar NaCl at 35° C. were added with stirring and by double-jet, a 4.0 molar sodium chloride solution and a 4.0 molar silver nitrate solution for 0.4 minute at pAg 6.9 preparing 0.24 mole of AgCl emulsion.

EMULSION 15B

AgCl/AgBrI Epitaxial Emulsion Containing 2.5 Mole % AgCl 30 g of the tabular grain AgBrI (6 mole % iodide) Emulsion 5A was spectrally sensitized with 1.1 millimole of Dye A'/Ag mole and held for 15 minutes at 40° C. Then 10 g of the AgCl Emulsion 15A ($1\times10^{-3}$ mole) prepared above was added to the tabular grain AgBrI Emulsion 5A (0.04 mole) and stirred for 30 minutes at 40° C.

Figure 22:
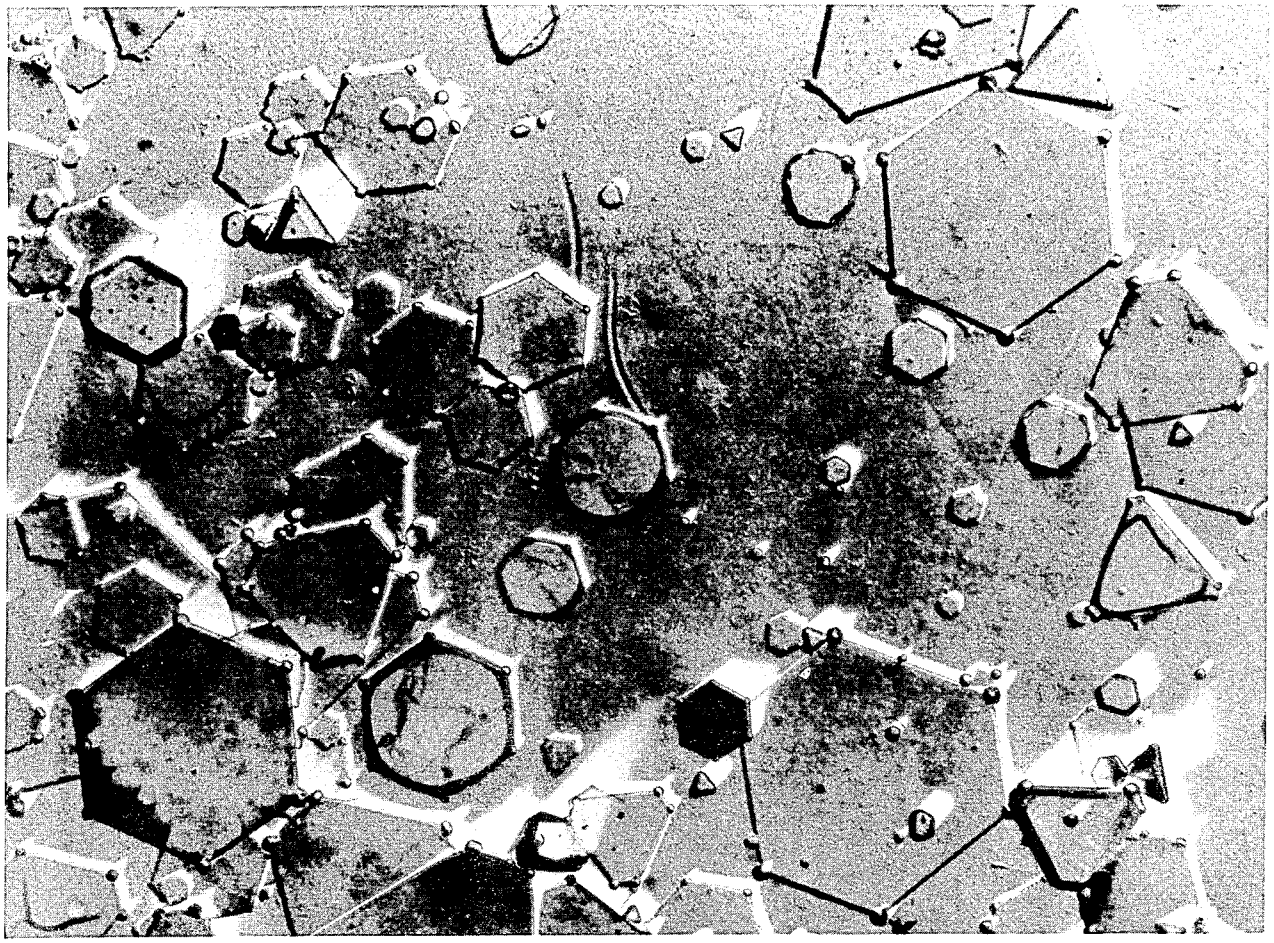

Electron micrographs reveal that the AgCl was selectively epitaxially deposited at the corners of the AgBrI tabular crystals. See FIG. 22 for a photomicrograph.

The invention has been described in detail with particular reference to preferred embodiments thereof, but it will be understood that variations and modifications can be effected within the spirit and scope of the invention.

What is claimed is:

1. A silver halide emulsion comprised of
a dispersing medium,
silver halide host grains predominantly bounded by {111} crystal faces and containing insufficient iodide to direct silver salt epitaxy to selected surface sites of said grains, and
silver salt epitaxially located on and substantially confined to at least one of edge and corner sites of said grains.

2. A silver halide emulsion according to claim 1 wherein said silver halide host grains exhibit an average aspect ratio of less than 8:1.

3. A silver halide emulsion according to claim 1 wherein said dispersing medium is a peptizer.

4. A silver halide emulsion according to claim 3 wherein said peptizer is gelatin or a gelatin derivative.

5. A silver halide emulsion according to claim 1 wherein said silver halide host grains are comprised of bromide.

6. A silver halide emulsion according to claim 5 wherein said silver halide host grains are additionally comprised of iodide.

7. A silver halide emulsion according to claim 6 wherein said silver halide host grains contain less than 10 mole percent iodide.

8. A silver halide emulsion according to claim 7 wherein said silver halide host grains contain less than 8 mole percent iodide.

9. A silver halide emulsion according to claim 1 wherein said silver salt is silver halide.

10. A silver halide emulsion according to claim 9 wherein said silver salt is comprised of silver chloride.

11. A silver halide emulsion according to claim 1 wherein a site director is adsorbed to said silver halide host grains.

12. A silver halide emulsion according to claim 11 wherein iodide ions constitute said site director.

13. A silver halide emulsion according to claim 11 wherein said site director is a spectral sensitizing dye.

14. A silver halide emulsion according to claim 13 wherein said spectral sensitizing dye is adsorbed to said silver halide host grains in an aggregated form.

15. A silver halide emulsion according to claim 1 wherein at least one of said silver salt and said silver halide host grains contains a sensitivity modifier incorporated therein.

16. A silver halide emulsion according to claim 1 wherein said silver salt is epitaxially located on less than half of the surface area provided by said silver halide host grains.

17. A silver halide emulsion according to claim 16 wherein said silver salt is epitaxially located on less than 25 percent of the surface area provided by said silver halide host grains.

18. A silver halide emulsion according to claim 17 wherein said silver salt is epitaxially located on less than 10 percent of the surface area provided by said silver halide host grains.

19. A silver halide emulsion according to claim 1 wherein said silver salt is substantially confined to edge sites on said silver halide host grains.

20. A silver halide emulsion according to claim 1 wherein said silver salt is substantially confined to corner sites on said silver halide host grains.

21. A silver halide emulsion according to claim 1 wherein the major crystal faces of said silver halide host grains lie in {111} crystal planes.

22. A silver halide emulsion comprised of
a peptizer,
regular octahedral silver halide host grains bounded by {111} major crystal faces and containing less than 15 mole percent iodide, and
silver salt epitaxially located on and substantially confined to at least one of edge and corner sites of said grains.

23. A silver halide emulsion comprised of
a peptizer,
silver bromide host grains bounded by {111} major crystal faces,
silver chloride epitaxially located on and substantially confined to sites on said host grains chosen from corner and edge sites, and
a site director chosen from at least one of iodide ions and spectral sensitizing dye adsorbed to at least those portions of said major crystal faces free of said silver chloride.

24. A silver halide emulsion comprised of
a peptizer,
silver bromoiodide host grains bounded by {111} major crystal faces and containing less than 10 mole percent iodide,
silver chloride epitaxially located on and substantially confined to selected surface sites of said host grains chosen from edge and corner sites, and
a site director chosen from at least one of iodide ions and spectral sensitizing dye adsorbed to at least those portions of said major crystal faces free of said silver chloride.

25. A silver halide emulsion comprised of
gelatin or a gelatin derivative,
silver halide host grains bounded by {111} major crystal faces, said halide consisting essentially of bromide and up to 10 mole percent iodide,
silver chloride epitaxially located on and substantially confined to at least one of corner and edge sites on said silver halide host grains,and
an aggregating spectral sensitizing dye adsorbed to at least those portion of said major crystal faces free of epitaxially located silver chloride.

26. A silver halide emulsion according to claim 25 wherein said spectral sensitizing dye is present in a concentration of at least 70 percent of the surface area of said host grains.

27. A silver halide emulsion according to claim 24 wherein said spectral sensitizing dye is an aggregating cyanine or merocyanine dye.

28. A silver halide emulsion according to claim 27 wherein said spectral sensitizing dye is an aggregating cyanine dye containing at least one nucleus chosen from the group consisting of quinolinium, benzoxazolium, benzothiazolium, benzoselenazolium, benzimidazolium, naphthoxazolium, naphthothiazolium, and naphthoselenazolium nuclei.

29. A silver halide emulsion according to claim 28 wherein the spectral sensitizing dye is chosen from the group consisting of
Anhydro-9-ethyl-3,3'-bis(3-sulfopropyl)-4,5,4',5'-dibenzothiacarbocyanine hydroxide,
Anhydro-5,5'-dichloro-9-ethyl-3,3'-bis(3-sulfobutyl)-thiacarbocyanine hydroxide,
Anhydro-5,5',6,6'-tetrachloro-1,1'-diethyl-3,3'-bis(3-sulfobutyl)benzimidazolocarbocyanine hydroxide,
Anhydro-5,5',6,6'-tetrachloro-1,1',3-triethyl-3'-(3-sulfobutyl)benzimidazolocarbocyanine hydroxide,
Anhydro-5-chloro-3,9-diethyl-5'-phenyl-3'-(3-sulfopropyl)oxacarbocyanine hydroxide,
Anhydro-5-chloro-3',9-diethyl-5'-phenyl-3-(3-sulfopropyl)oxacarbocyanine hydroxide,
Anhydro-5-chloro-9-ethyl-5'-phenyl-3,3'-bis(3-sulfopropyl)oxacarbocyanine hydroxide,
Anhydro-9-ethyl-5,5'-diphenyl-3,3'-bis(3-sulfobutyl)oxacarbocyanine hydroxide,
Anhydro-5,5'-dichloro-3,3'-bis(3-sulfopropyl)thiacyanine hydroxide, and
1,1'-Diethyl-2,2'-cyanine p-toluenesulfonate.

30. In a photographic element comprised of a support and at least one radiation-sensitive emulsion layer, the improvement wherein said emulsion layer is comprised of an emulsion according to any one of claims 1 through 29.

31. A process of producing a visible photographic image comprising processing in an aqueous alkaline solution in the presence of a developing agent an imagewise exposed photographic element according to claim 30.

32. A process of preparing a silver halide emulsion comprising
providing an emulsion comprised of a dispersing medium and silver halide host grains predominantly bounded by {111} crystal faces and containing insufficient iodide to direct silver salt epitaxy to selected surface sites on the silver halide host grains,
adsorbing a site director on the silver halide host grains, and
epitaxially depositing a silver salt on the silver halide host grains and substantially confining epitaxial deposition to at least one of edge and corner sites on the silver halide grains.

33. A process according to claim 32 wherein the silver halide host grains are selected to have an average aspect ratio of less than 8:1.

34. A process according to claim 32 wherein the halide of the silver halide host grains is chosen to consist essentially of bromide.

35. A process according to claim 32 wherein the halide of the silver halide host grains is chosen to consist essentially of bromide and less than 10 mole percent iodide.

36. A process according to claim 32 wherein the halide of the silver halide host grains is chosen to consist essentially of bromide and less than 8 mole percent iodide.

37. A process according to claim 32 wherein the site director is comprised of iodide ions.

38. A process according to claim 32 wherein the site director is comprised of a spectral sensitizing dye.

39. A process according to claim 38 wherein the spectral sensitizing dye is selected from among aggregating cyanine and merocyanine dyes.

40. A process according to claim 39 wherein the spectral sensitizing dye is selected from among J-aggregating cyanine dyes.

* * * * *